US011568750B2

(12) United States Patent
Averbuch

(10) Patent No.: US 11,568,750 B2
(45) Date of Patent: Jan. 31, 2023

(54) METHOD AND APPARATUS FOR ESTIMATING FALSE POSITIVE REPORTS OF DETECTABLE ROAD EVENTS

(71) Applicant: HERE Global B.V., Eindhoven (NL)

(72) Inventor: Alex Averbuch, Buffalo Grove, IL (US)

(73) Assignee: HERE Global B.V., Eindhoven (NL)

( * ) Notice: Subject to any disclaimer, the term of this patent is extended or adjusted under 35 U.S.C. 154(b) by 115 days.

(21) Appl. No.: 17/219,307

(22) Filed: Mar. 31, 2021

(65) Prior Publication Data

US 2022/0319336 A1 Oct. 6, 2022

(51) Int. Cl.
*G08G 1/00* (2006.01)
*G08G 1/048* (2006.01)

(52) U.S. Cl.
CPC ..... *G08G 1/207* (2013.01); *G08G 1/048* (2013.01)

(58) Field of Classification Search
CPC ..... G08G 1/207; G08G 1/048
USPC ..... 340/989
See application file for complete search history.

(56) References Cited

U.S. PATENT DOCUMENTS

| | | | | |
|---|---|---|---|---|
| 10,311,728 | B2 | 6/2019 | Stenneth et al. | |
| 2018/0068495 | A1* | 3/2018 | Chainer | G07C 5/008 |
| 2019/0049256 | A1 | 2/2019 | Camp et al. | |
| 2020/0160626 | A1 | 5/2020 | Lei et al. | |

OTHER PUBLICATIONS

Hou et al., "VehSense: Slippery Road Detection Using Smartphones", 2017 IEEE 85th Vehicular Technology Conference (VTC2017—Spring), May 2017, 5 pages.

* cited by examiner

*Primary Examiner* — Mohamed Barakat
*Assistant Examiner* — Sharmin Akhter
(74) *Attorney, Agent, or Firm* — Ditthavong, Steiner & Mlotkowski

(57) ABSTRACT

An approach is provided for estimating false positive reports of detectable road events. For example, the approach involves determining a first number of road reports from a fleet of vehicles, and operating in a geographic area during a first time period and a second number of road reports from the fleet operating in the geographic area during a second time period. The first number of road reports and the second number of reports relate to a road event detected by vehicle sensors. The approach further involves computing a difference between the first number and the second number. The approach further involves determining a percentage of defective vehicles in the fleet based on the difference. The defective vehicles are defective with respect to a detection of the road event. The approach further involves providing the percentage of defective vehicles as an output.

20 Claims, 14 Drawing Sheets

200

400

500

700

METHOD AND APPARATUS FOR ESTIMATING FALSE POSITIVE REPORTS OF DETECTABLE ROAD EVENTS

BACKGROUND

Navigation and mapping service providers are continually challenged to provide digital maps with traffic incident reports and road-related event reports to support navigation applications and advanced applications such as autonomous driving. For example, providing users up-to-date data on road events (e.g., slippery conditions) can potentially reduce congestion and improve safety. Modern vehicles are increasingly capable of sensing and reporting various road-related events as they travel throughout a road network. Typically, slippery road reports are based on vehicle sensor data. However, there are false positive road event reports resulted from factors other than the slipperiness of the roadway. Accordingly, navigation and mapping service providers face significant technical challenges to differentiating between true and false reports (such as slippery road reports), particularly when receiving reports from thousands or millions of vehicles in real-time.

SOME EXAMPLE EMBODIMENTS

Therefore, there are needs for estimating false positive reports of detectable road events (e.g., slippery conditions).

According to one or more example embodiments, a method comprises determining a first number of road reports from a fleet of vehicles operating in a geographic area during a first time period and a second number of road reports from the fleet of vehicles. The method also comprises operating in the geographic area during a second time period. The first number of road reports and the second number of reports relate to a road event detected by one or more vehicle sensors. The method further comprises computing a difference between the first number of road reports and the second number of road report. The method further comprises determining a percentage of defective vehicles in the fleet of vehicles based on the difference. The defective vehicles are defective with respect to a detection of the road event. The method further comprises providing the percentage of defective vehicles as an output, According to another embodiment, an apparatus comprises at least one processor, and at least one memory including computer program code for one or more programs, the at least one memory and the computer program code configured to, with the at least one processor, to cause, at least in part, the apparatus to generate a map layer based on road reports reported by a fleet of vehicles operating in a geographic area. The apparatus is also caused to quantify a quality of the map layer based on a percentage of defective vehicles in the fleet of vehicles. The defective vehicles are defective with respect to a detection of a road event. The apparatus is further caused to selectively provide the map layer as an output based on the quality of the map layer. The percentage of defective vehicles in the fleet of vehicles is determined based on a difference between a first number of road reports from the fleet of vehicles during a first time period and a second number of road reports from the fleet of vehicles during a second time period. The first number of road reports and the second number of road reports relate to the road event detected by one or more vehicle sensors.

According to another embodiment, a computer-readable storage medium carrying one or more sequences of one or more instructions which, when executed by one or more processors, cause, at least in part, an apparatus to determine a fleet management plan for a fleet of vehicles based on a percentage of defective vehicles in the fleet of vehicles, wherein the defective vehicles are defective with respect to a detection of a road event. The apparatus is also caused to provide the fleet management plan as an output. The percentage of defective vehicles in the fleet of vehicles is determined based on a difference between a first number of road reports from the fleet of vehicles during a first time period and a second number of road reports from the fleet of vehicles during a second time period. The first number of road reports and the second number of road reports relate to the road event detected by one or more vehicle sensors.

According to another embodiment, an apparatus comprises means for generating a map layer based on road reports reported by a fleet of vehicles operating in a geographic area. The apparatus also comprises means for quantifying a quality of the map layer based on a percentage of defective vehicles in the fleet of vehicles. The defective vehicles are defective with respect to a detection of a road event. The apparatus further comprises means for selectively providing the map layer as an output based on the quality of the map layer. The percentage of defective vehicles in the fleet of vehicles is determined based on a difference between a first number of road reports from the fleet of vehicles during a first time period and a second number of road reports from the fleet of vehicles during a second time period. The first number of road reports and the second number of road reports relate to the road event detected by one or more vehicle sensors.

In addition, for various example embodiments of the invention, the following is applicable: a method comprising facilitating a processing of and/or processing (1) data and/or (2) information and/or (3) at least one signal, the (1) data and/or (2) information and/or (3) at least one signal based, at least in part, on (including derived at least in part from) any one or any combination of methods (or processes) disclosed in this application as relevant to any embodiment of the invention.

For various example embodiments of the invention, the following is also applicable: a method comprising facilitating access to at least one interface configured to allow access to at least one service, the at least one service configured to perform any one or any combination of network or service provider methods (or processes) disclosed in this application.

For various example embodiments of the invention, the following is also applicable: a method comprising facilitating creating and/or facilitating modifying (1) at least one device user interface element and/or (2) at least one device user interface functionality, the (1) at least one device user interface element and/or (2) at least one device user interface functionality based, at least in part, on data and/or information resulting from one or any combination of methods or processes disclosed in this application as relevant to any embodiment of the invention, and/or at least one signal resulting from one or any combination of methods (or processes) disclosed in this application as relevant to any embodiment of the invention.

For various example embodiments of the invention, the following is also applicable: a method comprising creating and/or modifying (1) at least one device user interface element and/or (2) at least one device user interface functionality, the (1) at least one device user interface element and/or (2) at least one device user interface functionality based at least in part on data and/or information resulting from one or any combination of methods (or processes)

disclosed in this application as relevant to any embodiment of the invention, and/or at least one signal resulting from one or any combination of methods (or processes) disclosed in this application as relevant to any embodiment of the invention.

In various example embodiments, the methods (or processes) can be accomplished on the service provider side or on the mobile device side or in any shared way between service provider and mobile device with actions being performed on both sides.

For various example embodiments, the following is applicable: An apparatus comprising means for performing the method of any of the claims.

Still other aspects, features, and advantages of the invention are readily apparent from the following detailed description, simply by illustrating a number of particular embodiments and implementations, including the best mode contemplated for carrying out the invention. The invention is also capable of other and different embodiments, and its several details can be modified in various obvious respects, all without departing from the spirit and scope of the invention. Accordingly, the drawings and description are to be regarded as illustrative in nature, and not as restrictive.

BRIEF DESCRIPTION OF THE DRAWINGS

The embodiments of the invention are illustrated by way of example, and not by way of limitation, in the figures of the accompanying drawings.

DESCRIPTION OF SOME EMBODIMENTS

Examples of a method, apparatus, and computer program for estimating false positive reports of detectable road events using two groups of vehicles are disclosed. In the following description, for the purposes of explanation, numerous specific details are set forth in order to provide a thorough understanding of the embodiments of the invention. It is apparent, however, to one skilled in the art that the embodiments of the invention may be practiced without these specific details or with an equivalent arrangement. In other instances, well-known structures and devices are shown in block diagram form in order to avoid unnecessarily obscuring the embodiments of the invention.

Although various embodiments are described with respect to slippery conditions, it is contemplated that the approaches of the various embodiments described herein are applicable to other road events that are external to vehicles and detectible by vehicle sensors, such as a pedestrian detecting event, a signage detecting event, a road divider detecting event, an accident detecting event, a congestion detecting event, etc.

Service providers and original vehicle manufacturers (OEM) are increasingly developing compelling navigation and other location-based services that improve the overall driving experience for end users by leveraging the sensor data collected by connected vehicles as they travel. For example, the vehicles can use their respective sensors to detect slippery road conditions (e.g., loss of adhesion between the vehicle and the road on which it is traveling), which in turn can be used for issuing local hazard warning, updating real-time mapping data, as inputs into a mapping data pipeline process, and/or any other purpose.

To provide users with up-to-date data on road events (e.g., slippery conditions), navigation and mapping service providers commonly acquire road event data from various OEMs with different quality levels, some of which includes more false positive road event reports than the others. For instance, vehicles of one OEM with high engine torque and a specific combination of a head unit and electronic stability control (ESP) electronic control units (ECUs) generate false slippery road event reports when driving with high acceleration values. Although such problem was fixed for the last affected model series in production, the affected vehicles are still out in the field generating false positive slippery road event reports. Navigation and mapping service providers are facing the technical challenge of estimating the number of false positive slippery road event reports without information from the OEM to detect which vehicles generating such error.

Figure 1:
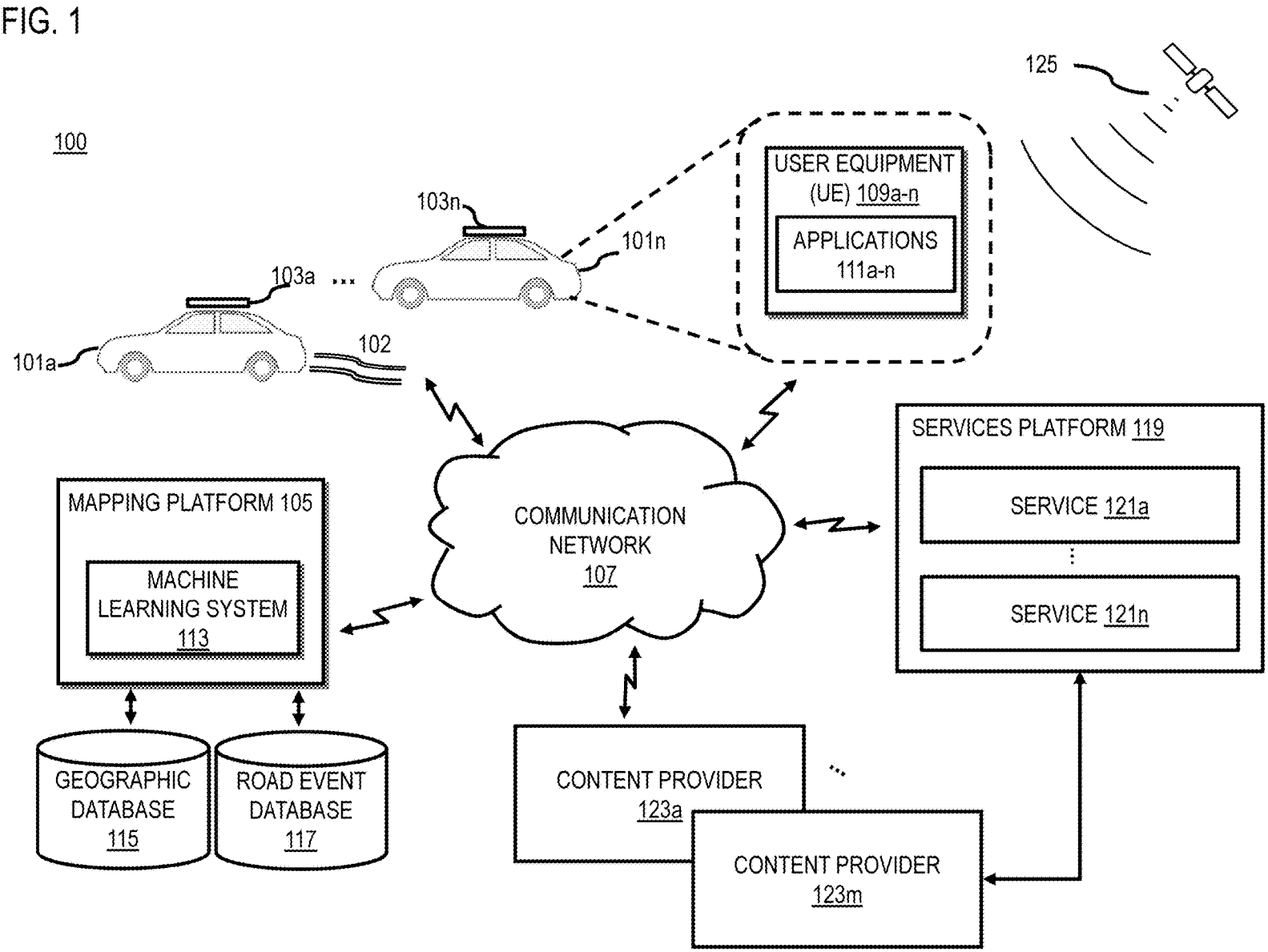
FIG. 1 is a diagram of a system capable of estimating false positive reports of detectable road events using two groups of vehicles, according to one or more example embodiments.
Figure 2:
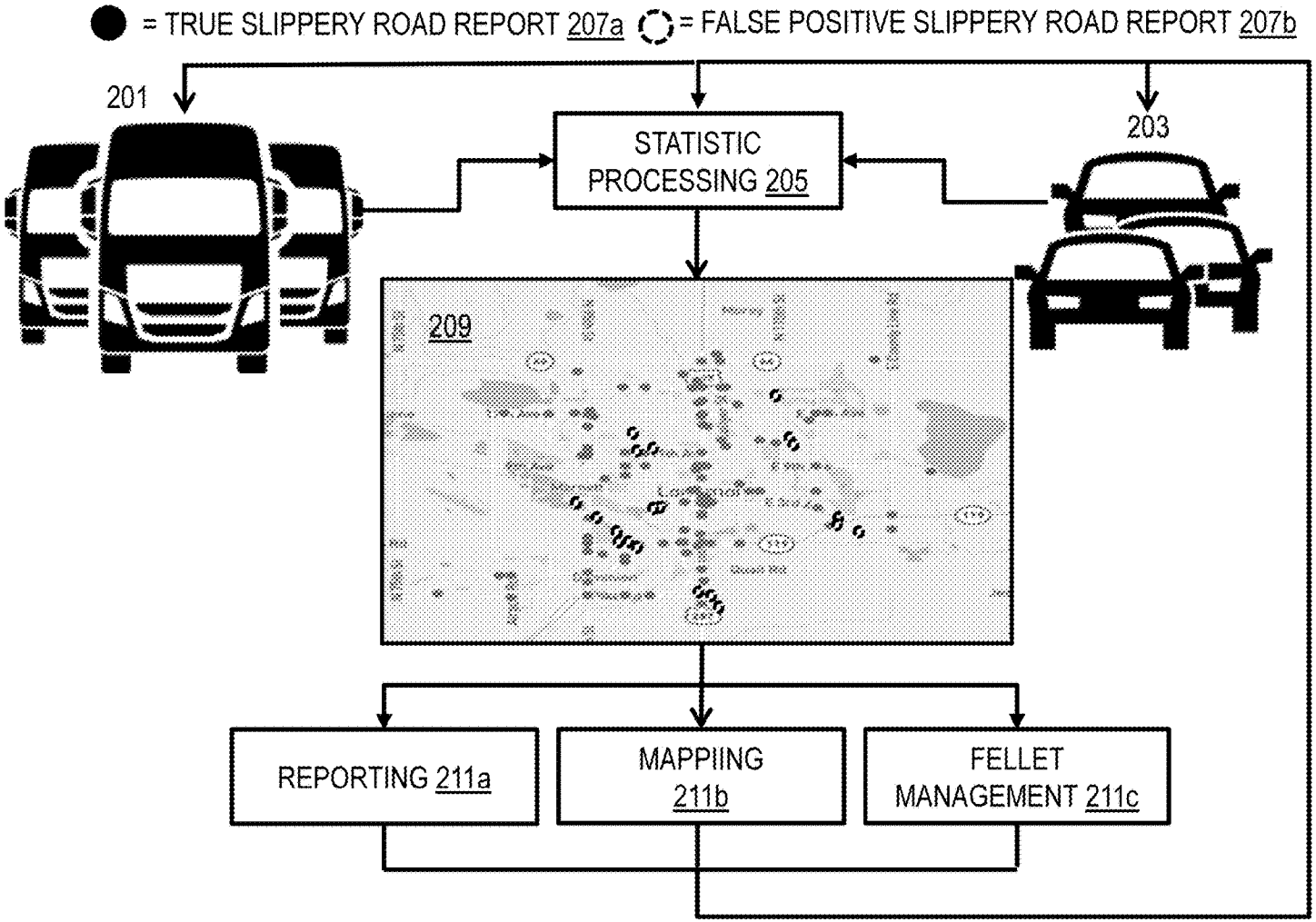
FIG. 2 is a diagram of an example process for estimating false positive reports of detectable road events using two groups of vehicles, according to one or more example embodiments.

To address these problems, a system 100 of FIG. 1 introduces the capability of estimating false positive reports of detectable road events using two groups of vehicles. FIG. 1 is a diagram of a system 100 capable of estimating false positive reports of detectable road events using two groups of vehicles, according to one or more example embodiments. The system 100 can improve map data and deliver dynamic road event content to vehicles. FIG. 2 is a diagram 200 of an example process for estimating false positive reports of detectable road events using two groups of vehicles, according to one or more example embodiments. In one embodiment, the system 100 can acquire slippery road event sensor data/signals from a first fleet/group of vehicles 201 and a second fleet/group of vehicles 203, perform a statistic processing 205 on the sensor data/signals to distinguish false positive slippery road event signals/reports 207*b* from true slippery road event signals/reports

207*a*, and then map-match the event signals/reports 207*a*, 207*b* into a slippery road event map 209. By way of example, the true slippery road event signals/reports 207*a* are marked as black dots while the false positive slippery road event signals/reports 207*b* are marked as white dots with outlines in the slippery road event map 209.

In one embodiment, the system 100 can estimate a number of false positive slippery road signals reported by the vehicles 201, 203 by assuming the first fleet/group of vehicles 201 as non-problematic vehicles (that generate slippery road events only on really slippery roads) and the second fleet/group of vehicles 203 as problematic vehicles (that generate slippery road events on non-slippery roads as well), and then calculating a percentage of false positive signals statistically. The system 100 can compare a number of slippery road events generated on a dry/sunny day in an area with a number of slippery road events generated on a slippery day (e.g. rain, snowstorm etc.) in the area to determine the number of false positive events reported by the problematic vehicles 203. In other words, the system 100 can use two fleets/groups rather than individual vehicles regardless map features, to analyze a statistical difference in the numbers of slippery events detected by a "good" (non-problematic) fleet and a "bad" (problematic) fleet with respect to possible false positive detections under different known slippery and dry weather conditions. Based on the difference, the system 100 can calculate a percentage of defective vehicles (e.g., 10% vehicles with errors and 90% good vehicles) in the fleet and how likely the "bad" fleet 203 will detect false positive slippery road events, and proceed future slippery road event report data accordingly.

The bigger the difference between the two numbers of the road event reports (a dry day vs. a slipper day), the more reliable (i.e., a higher level of confidence) the percentage of defective vehicles in the fleet. In other words, the more extreme the first and second environmental conditions of the two days (dry vs. wet), the more reliable the percentage of defective vehicles in the fleet. Such environmental conditions are independent from the fleet. The system 100 can set thresholds for sufficient slippery or dry. Rather than two days, the system 100 can use any two time periods (e.g., three hours of the same day, three hours of the same time of two different days, two different weeks, etc.) with sufficiently different environmental conditions to provide reliable results.

By way of example, the whole fleet includes 10,000 vehicles, including 9,000 vehicles with good sensors/on-board systems and 1,000 vehicles with bad sensors/on-board systems. Although new vehicles are adding from time to time, the fleet size stays about the same, and the ratio of defective vehicles (e.g., 10%) does not change substantially over time.

In one embodiment, in a reporting processing 211*a*, the system 100 can adjust the total number of the slippery road event reports by the number of the false positive slippery road event reports, then (1) broadcast one or more slippery road event messages including the adjusted slippery road event reports, (2) publish digital map data including the adjusted slippery road event reports, etc. to the vehicles of the fleets and other vehicles traveling in the area.

In another embodiment, in a mapping processing 211*b*, the system 100 can adjust the total number of the slippery road event reports by the number of the false positive slippery road event reports, then can update a road event map layer and/or a geographic database with the adjusted slippery road event reports. Such road event map layer and/or geographic database can be accessed by the vehicles of the fleets, other vehicles traveling in the area, location-based services, etc.

In yet another embodiment, in a fleet management processing 211*c*, the system 100 can apply the percentage of defective vehicles in a fleet to (1) determine a replacement rate for the fleet of vehicles, (2) estimate a maintenance status of the fleet of vehicles, etc., for the fleet operators.

In FIG. 2, the first fleet/group of vehicles 201 are depicted as trucks and the second fleet/group of vehicles 203 are depicted as passenger cars for simplification. In other embodiments, either group can include one or more types/models of vehicles belonging to any numbers of public and/or private entities.

Referring to the example of the OEM vehicles with a high engine torque and the specific combination of a head unit and ESP ECUs, the second fleet/group of vehicles 203 can the fleet of vehicles belonging to this OEM that generate false positive slippery road event reports when driving with high acceleration values, while the first fleet/group of vehicles 201 can a fleet of vehicles belonging to another OEM. A number of slippery road event reports generated by the other OEM can depend just on the actual number of slippery road segments/events and a size of the other OEM fleet in the area, while the false positive slippery road event reports can be generated only by some defect vehicles of the second fleet/group of vehicles 203. Therefore, having two days in the same area and approximately the same sizes of fleets with very different number of slippery road events reported, the system 100 can observe very different impact of the false positive cases caused by defect vehicles of the OEM at issue, and calculate actual impact of the defective vehicles on the false positive cases.

In one embodiment, the system 100 can calculate the percentage of false positive slippery road event signals/reports statistically. The system 100 can assume that both problematic and non-problematic vehicles generate slippery road event signals/reports on really slippery roads, while only problematic vehicles generate false positive slippery road event signals/reports on non-slippery roads. In other words, the system 100 can take data at time periods when the condition is definitely true or almost definitely true, and at time periods when the condition is definitely false or almost definitely false, to calculate from both numbers an approximate percentage of the fleet reporting erroneously. In reality, the compassion vehicle group can have ignorable defective vehicles instead no defective vehicles.

By way of example, the system 100 can take data on a slippery day (e.g., rain, snowstorm, ice, etc.) in an area of interest, the percentage of false positive road event signals/reports would be low, because there may be some non-slippery roads and conditions for the false positive signals, but the majority of the slippery road event signals/reports would be real ones, both from the OEM at issue and the other OEM. As opposed to that, on a dry sunny summer day when no slippery roads are in the area, the majority of the slippery road event signals/reports would be false positive ones generated by defective vehicles of the OEM at issue with the described problem (e.g., with a high engine torque and the specific combination of a head unit and ESP ECUs). Therefore, selecting two days having substantially different number of slippery road event events in the same area, the system 100 can observe that the ratio of the number of events provided on the dry day over the number of events provided on the slippery day by the OEM at issue would be substantially different from the ratio by the other OEMs without the described problem. The system 100 can develop and use formulae as follows to calculate a percentage of the defective vehicle in the OEM at issue.

In one embodiment, the system 100 can compare two similar time periods, for instance, two days (day 1, day 2) with two sets of actual slippery road segments $S_{act1}$ and $S_{act2}$ having a substantial difference. Assuming that the actual number of road segments in the area is $Seg_{tot}$, the numbers of non-slippery road segments in the area can be expressed as $N_{act1}=Seg_{tot}-S_{act1}$ and $N_{act2}=Seg_{tot}-S_{act2}$ respectively. In one scenario, vehicles of another OEM fleet produces $X_{other}$ slippery road event reports for each road segment being slippery, and do not produce any slippery road event reports for each non-slippery road segment. In other words, the other OEM fleet can produce:

slippery road event reports for the day 1:

$$OEM_1=S_{act1}*X_{other} \tag{1}$$

slippery road event reports for the day 2:

$$OEM_2=S_{act2}*X_{other} \tag{2}$$

The system 100 can assume that the OEM fleet at issue produces $X_{tp}$ slippery road event reports for each segment being slippery (i.e., true positive) and $X_{fp}$ slippery road event reports for each non-slippery road segment (i.e., false positive due to, such as defects). In other words, the OEM fleet at issue can produce:

slippery road event reports for the day 1:

$$D_1=S_{act1}*X_{tp}+N_{act1}*X_{fp}=Seg_{tot}*X_{fp}+S_{act1}*(X_{tp}-X_{fp}) \tag{3}$$

slippery road event reports for the day 2:

$$D_2=S_{act2}*X_{tp}+N_{act2}*X_{fp}=Seg_{tot}*X_{fp}+S_{act2}*(X_{tp}-X_{fp}) \tag{4}$$

From (1) and (2), the system 100 can get:

$$S_{act2} = S_{act1} * \frac{OEM_2}{OEM_1} \tag{5}$$

The system 100 can substitute (5) in (4), and get:

$$D_2 = Seg_{tot} * X_{fp} + S_{act1} * \frac{OEM_2}{OEM_1} * (X_{tp} - X_{fp}) \tag{6}$$

From (3) and (6), the system 100 can get:

$$D_1 * \frac{OEM_2}{OEM_1} - D_2 = Seg_{tot} * X_{fp} * \left(\frac{OEM_2}{OEM_1} - 1\right) \tag{7}$$

and finally the number of false positive slippery road event reports:

$$X_{fp} = \frac{D_1 * \frac{OEM_2}{OEM_1} - D2}{Seg_{tot} * \left(\frac{OEM_2}{OEM_1} - 1\right)} \tag{8}$$

Therefore, the system 100 cam estimate the impact of false positive slippery road event signals/reports in the absence of the explicit information (e.g., the sizes of the fleets, the numbers of defective vehicles, etc.) from the road event report data sources (e.g., the OEMs).

By analogy, the system 100 can apply the above-discussed embodiments to detect false negative road event reports, such as wrongfully missed slippery conditions. The system 100 can statistically estimate the impact of "bad" vehicles reporting false negative slippery event by comparing total numbers of the ones reported by a "good" fleet and a "bad" fleet on a non-slippery day and on a slippery day.

As shown in FIG. 1, the system 100 can collect a plurality of instances of vehicle sensor data, and/or information of road events 102 (e.g., slippery road events) from one or more vehicles 101*a*-101*n* (also collectively referred to as vehicles 101) (e.g., conventional vehicles, autonomous vehicles, HAD vehicles, semi-autonomous vehicles, etc.) having one or more vehicle sensors 103*a*-103*n* (also collectively referred to as vehicle sensors 103) and having connectivity to a mapping platform 105 via a communication network 107. For example, the sensors 103 may include infrared sensors, LiDAR, radar, sonar, cameras (e.g., visible, night vision, etc.), global positioning system (GPS), and/or other devices/sensors that can scan and record data from the vehicle 101's surroundings for determining road event information.

In one instance, the system 100 can also collect the real-time sensor data, and/or road event information from one or more user equipment (UE) 109*a*-109*n* (also collectively referred to herein as UEs 109) associated with the vehicle 101 (e.g., an embedded navigation system), a user or a passenger of a vehicle 101 (e.g., a mobile device, a smartphone, etc.), or a combination thereof. In one instance, the UEs 109 may include one or more applications 111*a*-111*n* (also collectively referred to herein as applications 111) (e.g., a navigation or mapping application). In one embodiment, the mapping platform 105 includes a machine learning system 113 for analyzing the sensor data. The sensor data collected may be stored a geographic database 115 and/or a road event database 117.

In one embodiment, the system 100 may also collect real-time sensor data, and/or road event information from one or more other sources such as government/municipality agencies, local or community agencies (e.g., a police department), and/or third-party official/semi-official sources (e.g., a services platform 119, one or more services 121*a*-121*n* (collectively referred to as services 121), one or more content providers 123*a*-123*m* (collectively referred to as content providers 123), etc. as ground true data to verify false positive road event reporting rates.

In another embodiment, the sensor information can be supplemented with additional information from network-based services such as those provided by the services platform 119 and the services 121. By way of example, the services 121 can include mapping service, navigation services, and/or other data services that provide data for estimating false positive reports of detectable road events using two groups of vehicles. In one embodiment, the services platform 119 and/or the services 121 can provide contextual information such as weather, traffic, etc. as well as facilitate communications (e.g., via social networking services, messaging services, crowdsourcing services, etc.) among vehicles to share road event information. In one embodiment, the services platform 119 and/or the services 121 interact with content providers 123 who provide content data (e.g., map data, imaging data, road event data, etc.) to the services platform 119 and/or the services 121. In one embodiment, the UE 109 executes an application 119 that acts as client to the mapping platform 105, the services platform 119, the services 121, and/or the content providers 123. In one embodiment, the sensor data, contextual information, and/or configuration information can be stored in a database (e.g., the geographic database 115) for use by the mapping platform 105. All information shared by the system 100 should be filtered via privacy policy and rules set by the system 100 and/or data owners, such as removing private information before sharing with third parties.

Figure 3:
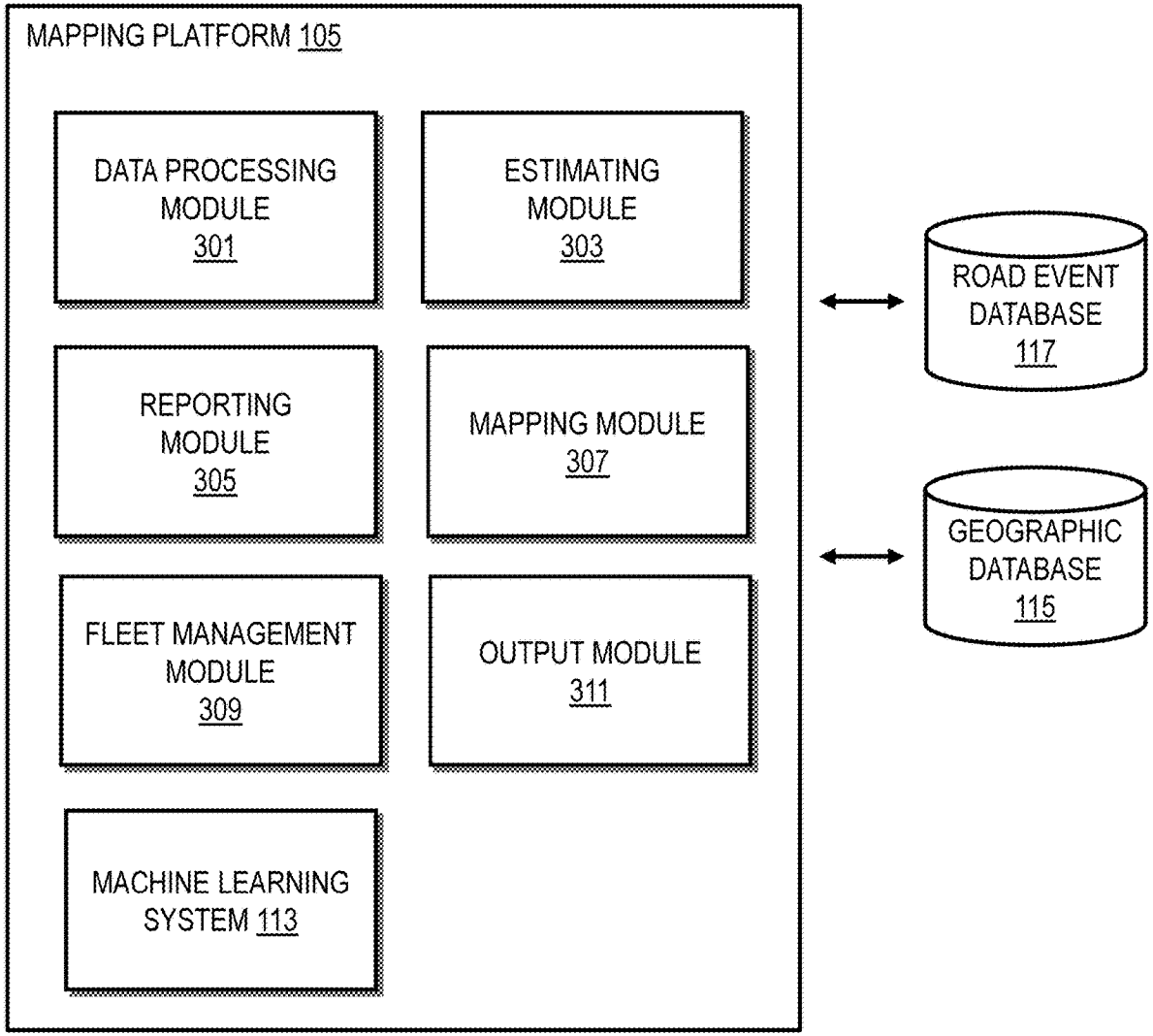
FIG. 3 is a diagram of the components of a mapping platform, according to one or more example embodiments.

FIG. 3 is a diagram of the components of the mapping platform 105, according to one embodiment. By way of example, the mapping platform 105 includes one or more components for providing hybrid traffic incident identification, according to the various embodiments described herein. It is contemplated that the functions of these components may be combined or performed by other components of equivalent functionality. In one embodiment, the mapping platform 105 includes a data processing module 301, an estimating module 303, a reporting module 305, a mapping module 307, a fleet management module 309, an output module 311, and the machine learning system 113 has connectivity to the geographic database 115 and/or the road event database 117. The above presented modules and components of the mapping platform 105 can be implemented in hardware, firmware, software, or a combination thereof. Though depicted as a separate entity in FIG. 1, it is contemplated that the mapping platform 105 may be implemented as a module of any other component of the system 100. In another embodiment, the mapping platform 105, the machine learning system 113, and/or the modules 301-311 may be implemented as a cloud-based service, local service, native application, or combination thereof. The functions of the mapping platform 105, the machine learning system 113, and/or the modules 301-311 are discussed with respect to FIGS. 4-8.

Figure 4:
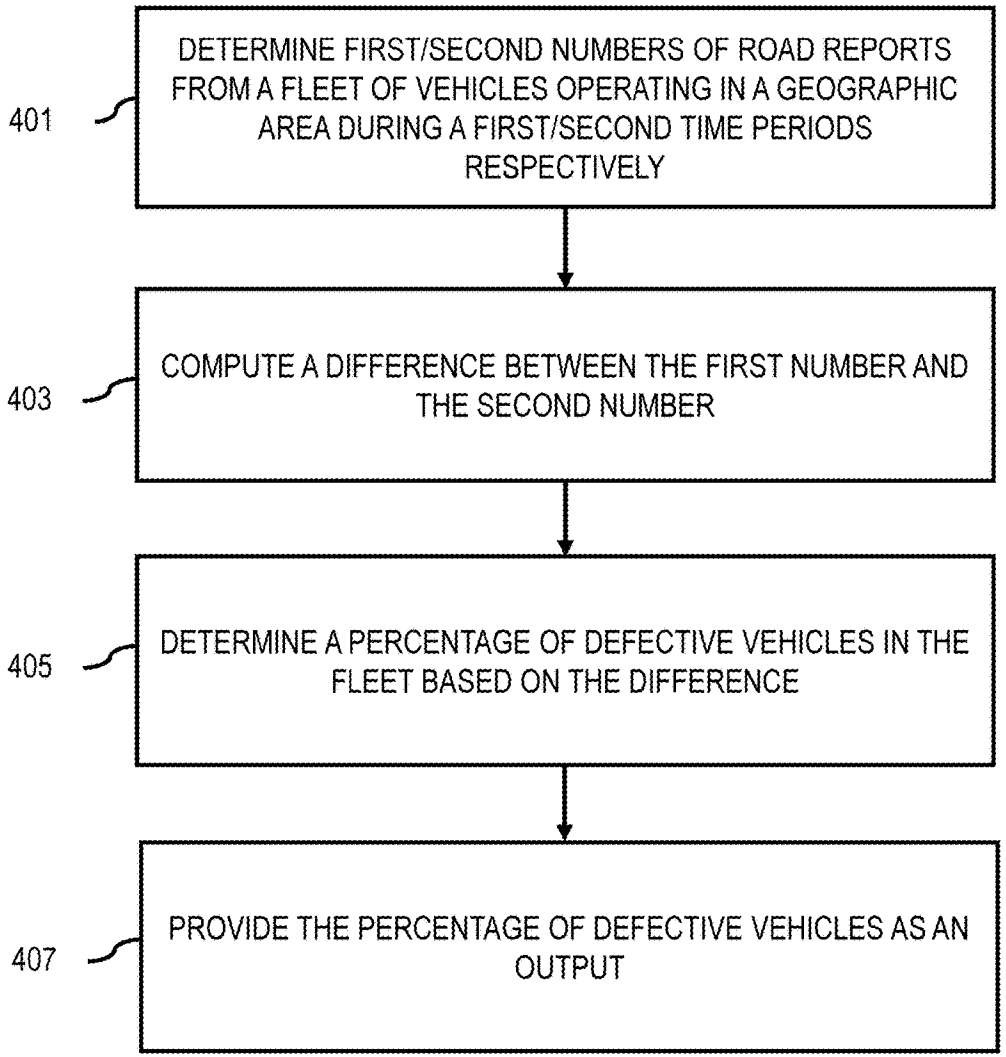
FIG. 4 is a flowchart of a process for estimating false positive reports of detectable road events using two groups of vehicles, according to one or more example embodiments.
Figure 11:
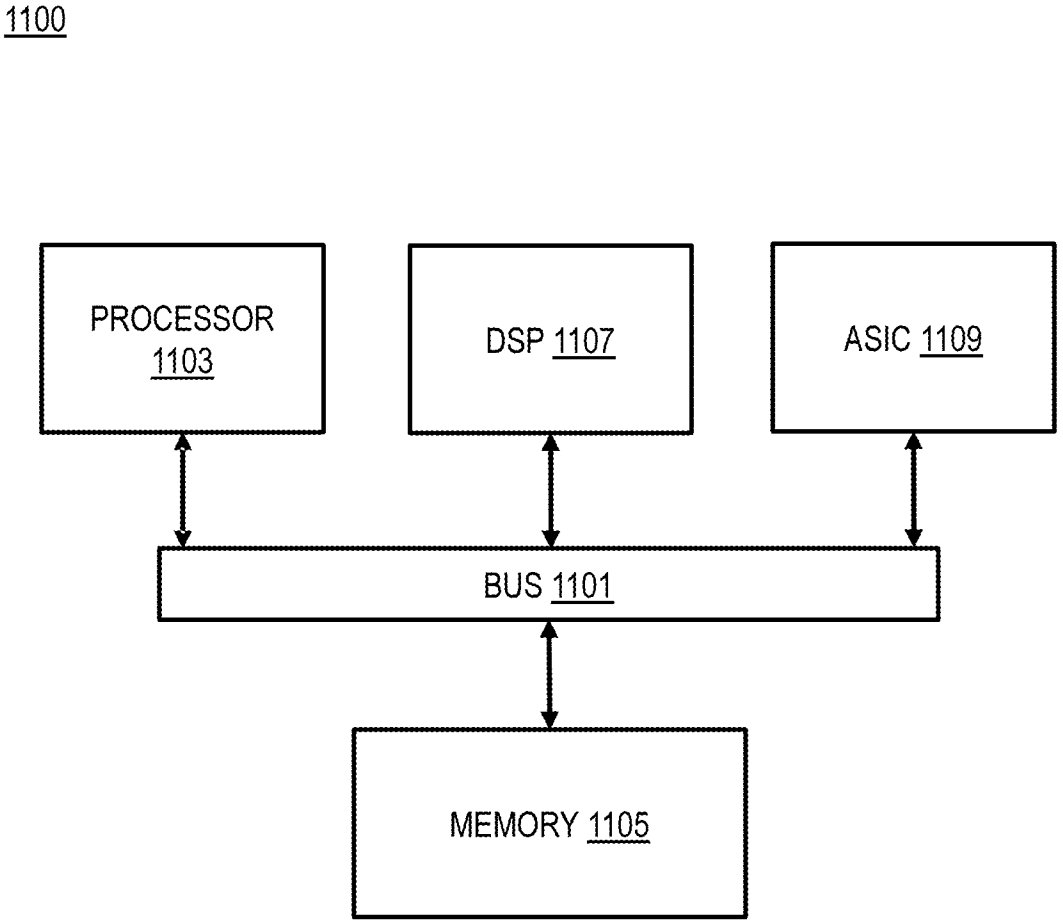
FIG. 11 is a diagram of a chip set that can be used to implement a system or process described herein, according to one or more example embodiments.

FIG. 4 is a flowchart of a process 400 for estimating false positive reports of detectable road events using two groups of vehicles, according to one or more example embodiments. In various embodiments, the mapping platform 105, the machine learning system 113, and/or any of the modules 301-311 may perform one or more portions of the process 400 and may be implemented in, for instance, a chip set including a processor and a memory as shown in FIG. 11. As such, the mapping platform 105 and/or the modules 301-311 can provide means for accomplishing various parts of the process 400, as well as means for accomplishing embodiments of other processes described herein in conjunction with other components of the system 100. The steps of the process 400 can be performed by any feasible entity, such as the mapping platform 105, the modules 301-311, etc. Although the process 400 is illustrated and described as a sequence of steps, it is contemplated that various embodiments of the process 400 may be performed in any order or combination and need not include all the illustrated steps.

In one embodiment, for example in step 401, the estimating module 303 can determine a first number of road reports from a fleet of vehicles operating in a geographic area during a first time period (e.g., a rainy day) and a second number of road reports from the fleet of vehicles operating in the geographic area during a second time period (e.g., a dry day). The first number of road reports and the second number of reports relate to a road event detected by one or more vehicle sensors (e.g., the sensors 103 of the vehicles 101). By way of example, the road event is a slippery road event.

In one embodiment, the first time period can be associated with the geographic area experiencing a first environmental condition causing a slippery road condition above a threshold slipperiness level, while the second time period is associated with the geographic area experiencing a second environmental condition causing a dry road condition below a threshold dryness level. The bigger the difference between the two road event report numbers, the more reliable the percentage of defective vehicles in the fleet. Referring back to the slippery road event example, the more extreme the first and second environmental conditions (e.g., rainy vs dry), the more reliable the percentage of defective vehicles in the fleet. By way of example, the fleet has two groups of vehicles: the first group known to have no defective vehicle/sensors, thereby having a false positive rate equal to zero. On the other hand, the second group has only defective vehicles that produce false positive event reports. Assuming the total fleet size is 1,000, during a dry time period, the first group produce zero slippery road event, while the second group produce 150 slippery road events (i.e., false positives).

In one embodiment, in step 403, the estimating module 303 can compute a difference between the first number of road reports (e.g., 0) and the second number of road report (e.g., 150). As such, the estimating module 303 can calculate the number of defective vehicles as 150.

In one embodiment, in step 405, the estimating module 303 can determine a percentage of defective vehicles in the fleet of vehicles (e.g., 15%) based on the difference. The defective vehicles are defective with respect to a detection of the road event.

In another embodiment, referring back to the two-OEM example, where there are two original equipment manufacturers (OEMs) and the first OEM fleet is known to have no defective vehicle/sensors, thereby having a false positive rate equal to zero. On the other hand, the second OEM (or fleet) does have some defective vehicles that produce false positive event reports, but its fleet size and percentage of defective vehicles are unknown. In one embodiment, the estimating module 303 can use data from both OEMs (fleets) produced during two different time periods (e.g., days), i.e., four sets of data: first OEM (fleet) on the first day, first OEM (fleet) on the second day, second OEM (fleet) on the first day, and second OEM (fleet) on the second day. OEM1 is the number of road event reports produced by the first OEM (fleet) on the first day, OEM2 is the number of road event reports produced by the first OEM (fleet) on the second day, D1 is the number of road event reports produced by the second OEM on the first day, and D2 is the number of road event reports produced by the second OEM on the second day.

For instance, for the OEM, the estimating module 303 can determine a first OEM true positive rate $$\left(\text{e.g., } \frac{OEM_2}{OEM_1}\right)$$

based on a ratio of the first number of road reports (e.g., $OEM_1$) and the second number of road reports (e.g., $OEM_2$) determined from a first set of vehicles of the fleet of vehicles that are associated the first OEM. For a second OEM, the estimating module 303 can determine a second OEM false positive rate (e.g., $D_2/D_1$) based on a ratio of the first number of road reports (e.g., $D_1$) and the second number of road reports (e.g., D2) determined from a second set of vehicles of the fleet of vehicles that are associated the second OEM. Subsequently, the estimating module 303 can determine an OEM-specific percentage of defective vehicles in the second set of vehicles associated with the second OEM (e.g., $X_{fp}$) based on the first OEM true positive rate and the second OEM false positive rate (e.g., by comparing these two ratios and applying formula (8) to calculate the percentage of defective vehicles of the second OEM without the knowledge of the fleet size).

For instance, the first set of vehicles associated with the first OEM can include a number of defective vehicles below a threshold value, and the first set of vehicles and the second set of vehicles have an equal number of vehicles within a threshold range. As mentioned, in reality, the first OEM can have ignorable defective vehicles instead no defective vehicles.

In one embodiment, in step 407, the output module 311 can provide the percentage of defective vehicles as an output (e.g., to the reporting module 305). For instance, the reporting module 305 can adjust a total number of road reports subsequently reported by the fleet of vehicles in the geographic based on the percentage of defective vehicles. By way of example, the reporting module 305 can reduce a total number of road reports subsequently reported by the percentage of defective vehicles, and/or decrease a confidence of the total road report number.

As another example, when the confidence is lower than a threshold, the reporting module 305 can (1) decide not to send the road event data to customers, or (2) still send the road event data yet with the low confidence value, e.g., 15% of the fleet might report false positive road events, or (3) discontinue the road event data services if 90% of the fleet vehicles give false positive road event reports. For instance, an acceptable confidence threshold can be a number of a standard deviation.

In one embodiment, the reporting module 305 can report the percentage of defective vehicle, and/or the adjusted road event data to OEMs and/or update the respective OEM clouds. In one embodiment, the reporting module 305 can report the percentage of defective vehicle, and/or the adjusted road event data to a geographic database (e.g., the geographic database 115, and/or the road event database 117) to share with location-based services.

In one embodiment, the fleet management module 309 can determine a replacement rate for the fleet of vehicles based on the percentage of defective vehicles. For instance, the fleet management module 309 can a taxi fleet to prepare for expensive 5% repairs/replacement every 6 or 12 months (based on a 15% percentage of defective vehicles) to maintain the same level of event data reporting performance.

In another embodiment, the fleet management module 309 can estimate a maintenance status of the fleet of vehicles based on the percentage of defective vehicles. By way of example, the fleet management module 309 can analyze for the maintenance and reliability issues of the fleet, when detecting increasing false positive road event reports over time, to determine, for example, what part of the fleet is defective, the tires or other components of the vehicles are wearing out, etc.

In yet another embodiment, the fleet management module 309 can recommend a mapping service provider to adjust road event reporting payments to OEMs based on the quality of the road event report data. When there are too many false positive road event reports, the fleet management module 309 can recommend reducing payments or event dropping the OEM. In another embodiment, the fleet management module 309 can monitor the road event reporting performance (e.g., quality/confidence) and inform the OEM if it needs to fix the false positive reporting problems (i.e., feedback to improve the fleet).

Figure 5:
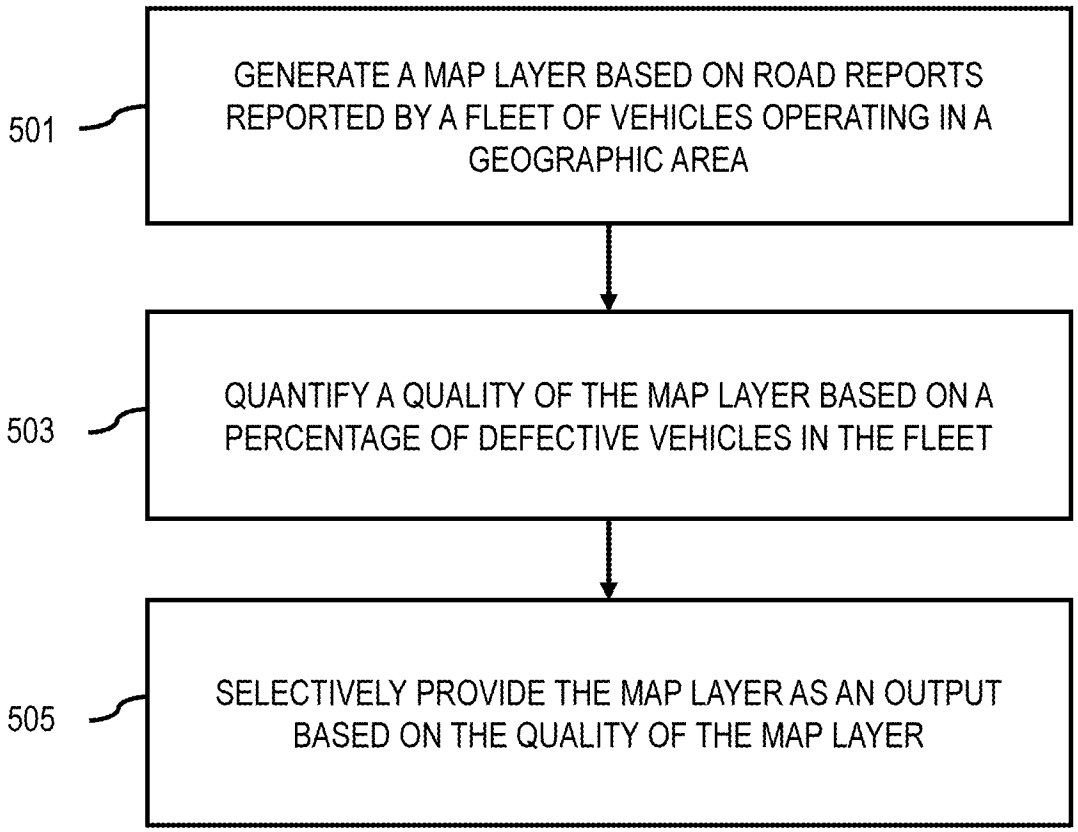
FIG. 5 is a flowchart of a process for generating a map layer of detectable road events, according to one or more example embodiments.

FIG. 5 is a flowchart of a process for generating and updating a map layer based on road reports, according to one or more example embodiments. In various embodiments, the mapping platform 105, the machine learning system 113, and/or any of the modules 301-311 may perform one or more portions of the process 500 and may be implemented in, for instance, a chip set including a processor and a memory as shown in FIG. 11. As such, the mapping platform 105 and/or the modules 301-311 can provide means for accomplishing various parts of the process 500, as well as means for accomplishing embodiments of other processes described herein in conjunction with other components of the system 100. The steps of the process 500 can be performed by any feasible entity, such as the mapping platform 105, the modules 301-311, etc. Although the process 500 is illustrated and described as a sequence of steps, it is contemplated that various embodiments of the process 500 may be performed in any order or combination and need not include all the illustrated steps.

In one embodiment, for example in step 501, the mapping module 307 can generate a map layer based on road reports reported by a fleet of vehicles operating in a geographic area. For instance, the road events can be slippery road events, pedestrian detecting events, signage detecting events, road divider detecting events, accident detecting events, or congestion detecting events.

Figure 6:
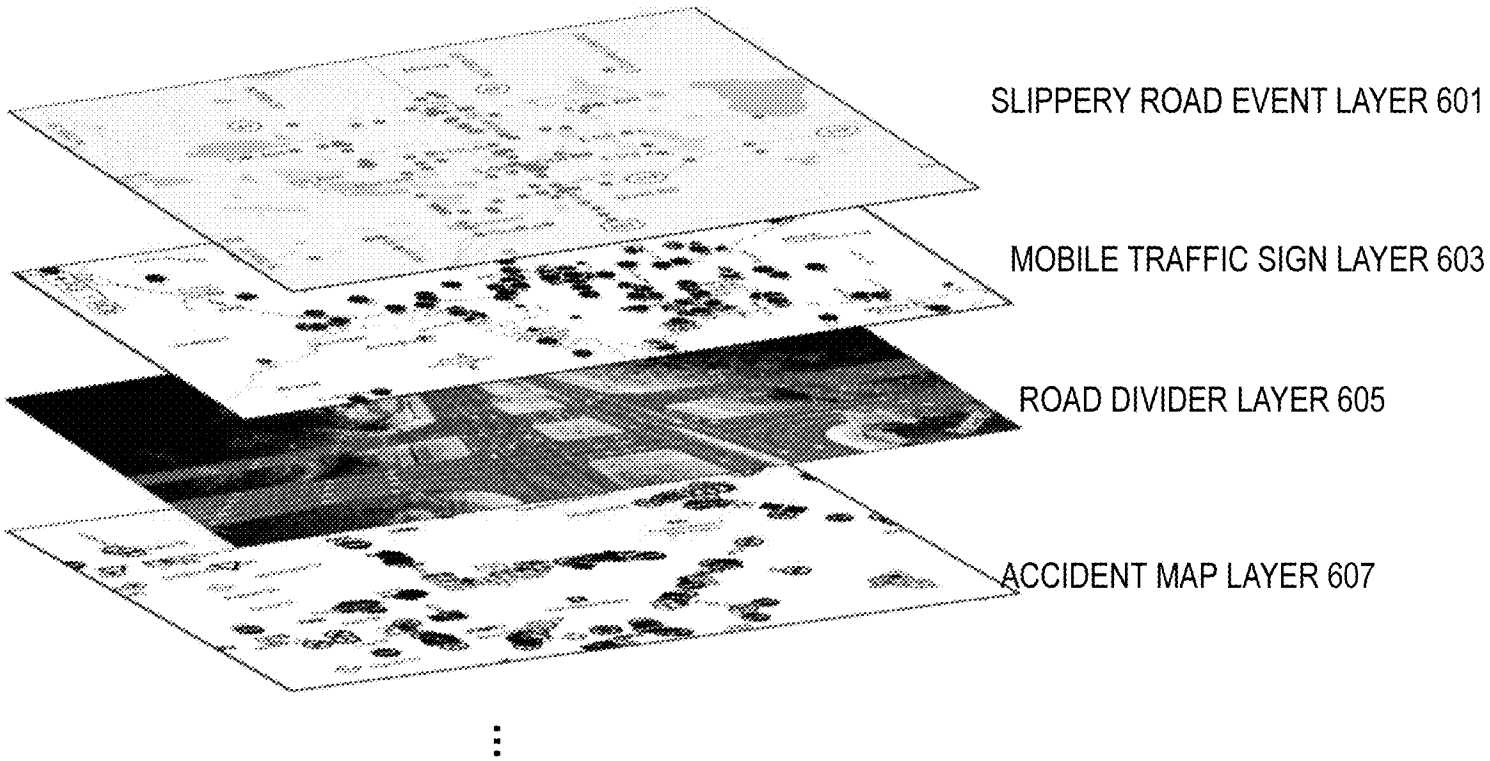
FIG. 6 is a diagram of example map layers, according to one or more example embodiments.

FIG. 6 is a diagram of example map layers, according to one or more example embodiments. For instance, the example map layers can include a slippery road event layer 601, a mobile traffic sign layer 603, a road divider layer 605, an accident map layer 607, etc. FIG. 6 is illustrative in nature, and not restrictive. Other example map layers can include a live traffic layer, a hazard warning layer, a weather layer, a cellular signal strength layer, a parking map layer, and other dynamic map object layers. Other map object layers may not change as often, yet are still applicable for a long time frame, such as a road geometry layer, a point of interest (POI) layer (e.g., a gas station layer), a 3D content layer, an electric vehicle charging station layer, a place footprint layer, etc.

In one embodiment, in step 503, the mapping module 307 can quantify a quality of the map layer (e.g., a confidence value) based on a percentage of defective vehicles in the fleet of vehicles. The defective vehicles can be defective with respect to a detection of a road event (e.g., a slippery road event). For instance, the percentage of defective vehicles (e.g., 15%) in the fleet of vehicles can be determined based on a difference between a first number of road reports from the fleet of vehicles during a first time period (e.g., a rainy day) and a second number of road reports from the fleet of vehicles during a second time period (e.g., a dry day). The first number of road reports and the second number of road reports relate to the road event detected by one or more vehicle sensors (e.g., the sensors 103 of the vehicles 101).

In one embodiment, the first time period is associated with the geographic area experiencing a first environmental condition causing a first road event condition above a threshold level, and the second time period is associated with the geographic area experiencing a second environmental condition causing a second road event condition below a threshold dryness level, and the second road event condition is opposite to the first road event condition (e.g., rainy vs dry).

In another embodiment, the mapping module 307 can filter or reject road reports from one or more original equipment manufacturer (OEM) sources each of which has a defective vehicle rate higher than a threshold, and the map layer can be generated based on the remaining road reports after the filtering or rejection. Referring back to the two- OEM example, for the first OEM, the estimating module 303 can determine a first OEM true positive rate $$\left(\text{e.g., } \frac{OEM_2}{OEM_1}\right)$$

based on a ratio of the first number of road reports (e.g., $OEM_1$) and the second number of road reports (e.g., $OEM_2$) determined from a first set of vehicles of the fleet of vehicles that are associated the first OEM. As mentioned, the first OEM fleet does not generate any false positive road event report. For a second OEM with some defective vehicles, the estimating module 303 can determine a second OEM false positive rate (e.g., $D_2/D_1$) based on a ratio of the first number of road reports (e.g., $D_1$) and the second number of road reports (e.g., D2) determined from a second set of vehicles of the fleet of vehicles that are associated the second OEM. Since the second OEM fleet has some defective vehicles, each of D1 and D2 includes true positive reports and false positive reports.

Subsequently, the estimating module 303 can determine an OEM-specific percentage of defective vehicles in the second set of vehicles associated with the second OEM (e.g., $X_{fp}$) based on the first OEM true positive rate and the second OEM false positive rate (e.g., by comparing these two ratios and applying formula (8) to calculate the percentage of defective vehicles of the second OEM without the knowledge of the fleet size).

By way of example, the first set of vehicles associated with the first OEM can include a number of defective vehicles below a threshold value, and the first set of vehicles and the second set of vehicles can have an equal number of vehicles within a threshold range. In this instance, the road reports from the second OEM can be filtered or rejected by the mapping module 307 based on the OEM-specific percentage of defective vehicles in the second set of vehicles (e.g., $X_{fp}$).

In one embodiment, in step 505, the output module 311 can selectively provide or publish the map layer as an output based on the quality of the map layer. For instance, the mapping module 307 can reduce a confidence of slippery road reporting by a fleet of vehicles based on the percentage of defective vehicles. When the reduced confidence is below a threshold, the output module 311 can either (1) stopping the providing of the number of false positive or false negative slippery road reports, the percentage of defective vehicles in the fleet, or a combination thereof as the output, or (2) providing the output with a reduced confidence.

Figure 8A:
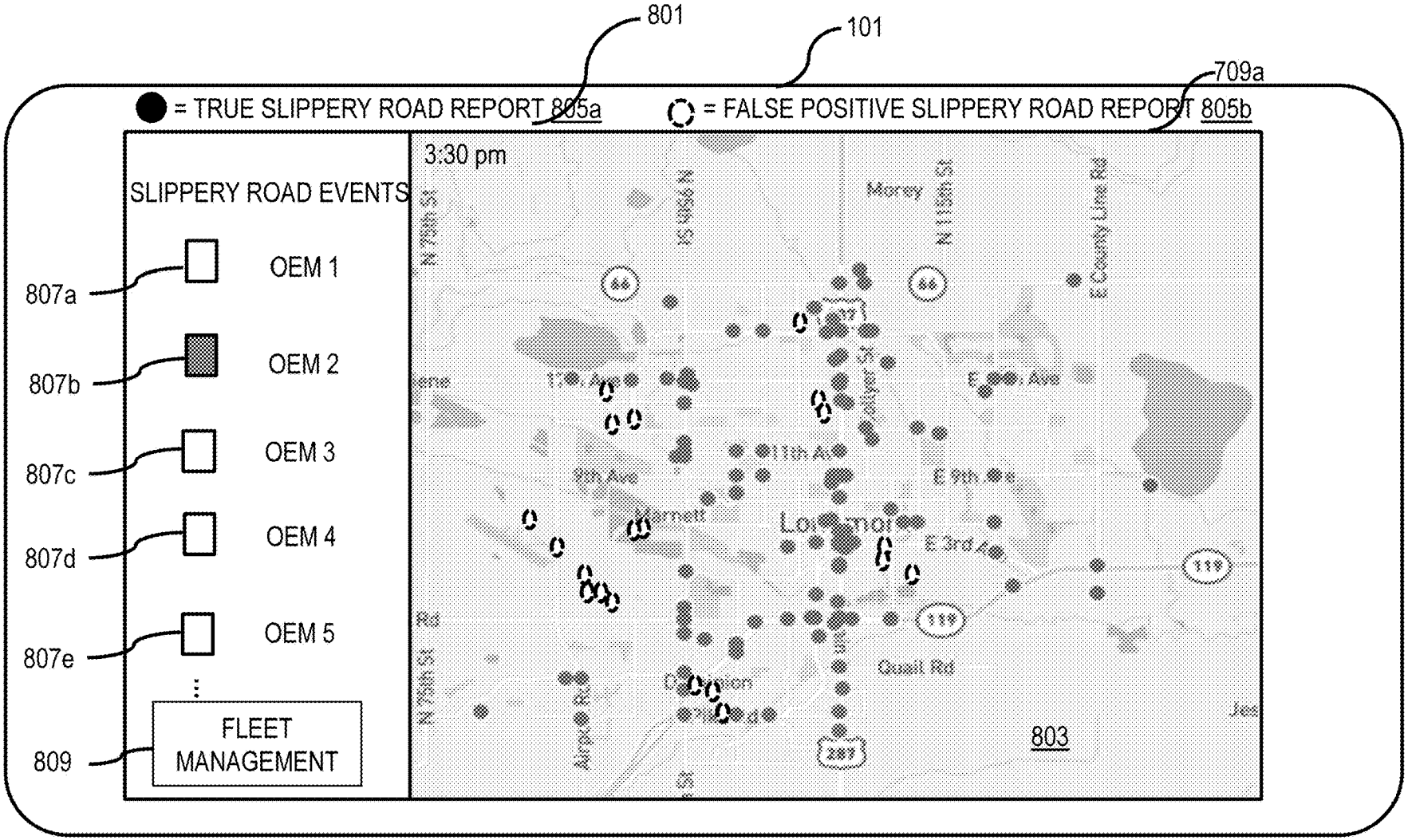
FIGS. 8A-8C are diagrams of example map user interfaces for adjusting and reporting detectable road events, according to various embodiments.
Figure 8B:
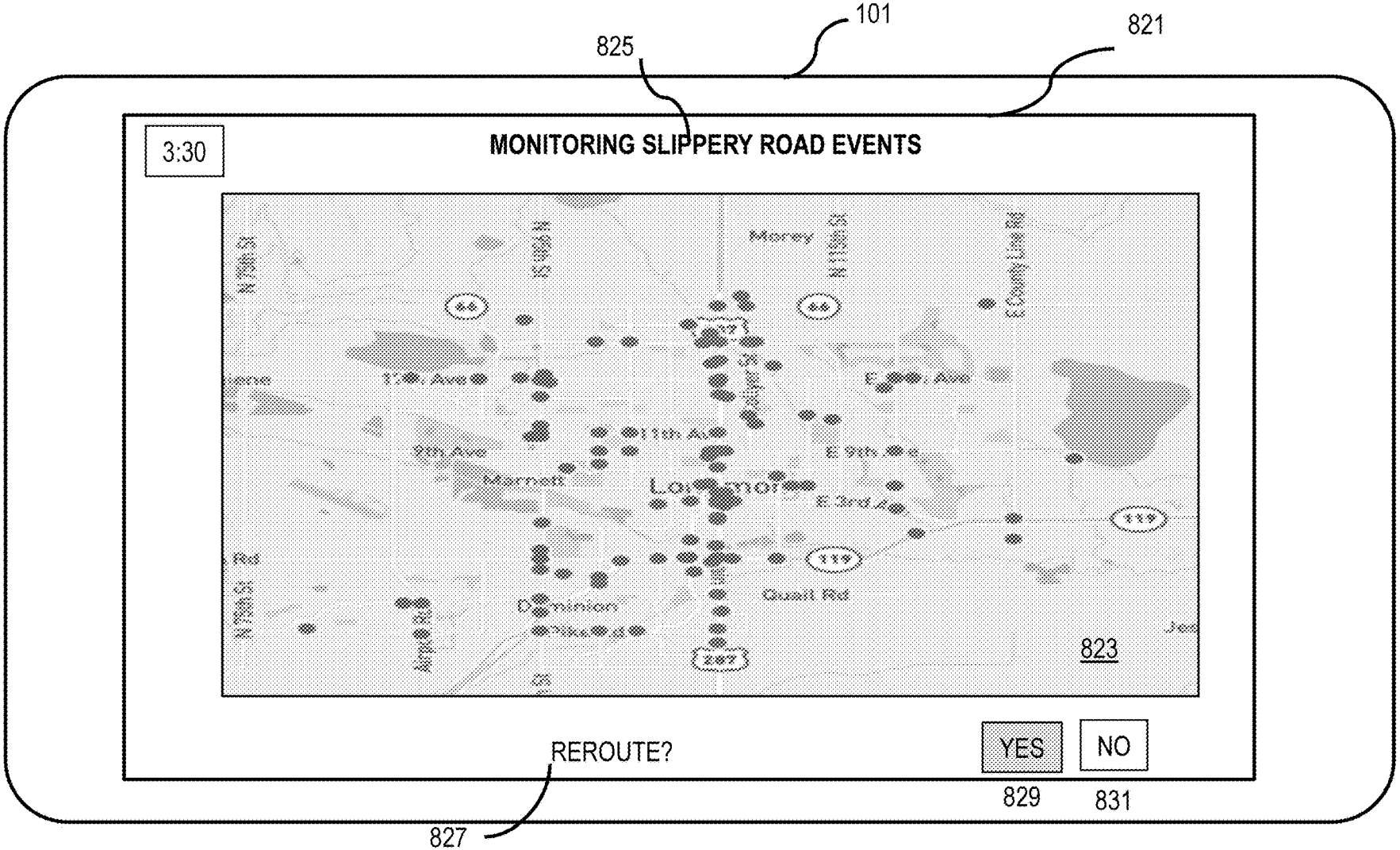

In one embodiment, the output module 311 can update a slippery road report map layer based on the number of the adjusted slippery road reports, and present on a user interface the number of the adjusted slippery road reports as in FIG. 8B.

Figure 7:
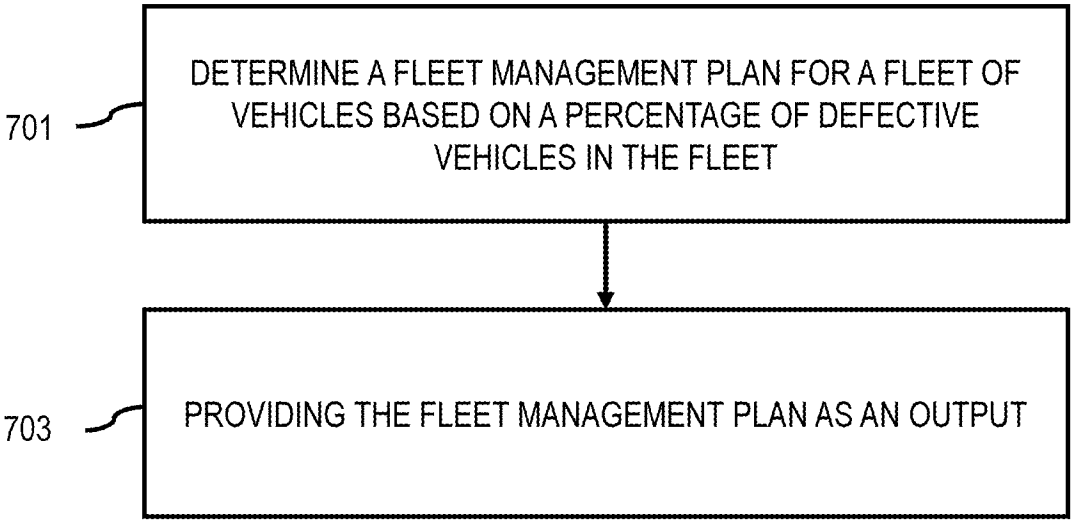
FIG. 7 is a flowchart of a process for planning fleet management, according to one or more example embodiments.

FIG. 7 is a flowchart of a process 700 for planning fleet management, according to one or more example embodiments. In various embodiments, the mapping platform 105, the machine learning system 113, and/or any of the modules 301-311 may perform one or more portions of the process 700 and may be implemented in, for instance, a chip set including a processor and a memory as shown in FIG. 11. As such, the mapping platform 105 and/or the modules 301-311 can provide means for accomplishing various parts of the process 700, as well as means for accomplishing embodiments of other processes described herein in conjunction with other components of the system 100. The steps of the process 700 can be performed by any feasible entity, such as the mapping platform 105, the modules 301-311, etc. Although the process 700 is illustrated and described as a sequence of steps, it is contemplated that various embodiments of the process 700 may be performed in any order or combination and need not include all the illustrated steps.

In one embodiment, for example in step 701, the fleet management module 309 can determine a fleet management plan for a fleet of vehicles based on a percentage of defective vehicles in the fleet of vehicles (e.g., 15%), and the defective vehicles are defective with respect to a detection of a road event (e.g., a slippery road event). For instance, the percentage of defective vehicles in the fleet of vehicles can be determined based on a difference between a first number of road reports from the fleet of vehicles during a first time period (e.g., a rainy day) and a second number of road reports from the fleet of vehicles during a second time period (e.g., a dry day). The first number of road reports and the second number of road reports relate to the road event detected by one or more vehicle sensors (e.g., the sensors 103 of the vehicles 101).

In one embodiment, the fleet management module 309 can monitor the percentage of defective vehicles in the fleet of vehicles overtime, and update the fleet management plan based on the monitored percentage of defective vehicles.

In another embodiment, the fleet management module 309 can determine a replacement rate for the fleet of vehicles based on the percentage of defective vehicles, and estimating a maintenance status of the fleet of vehicles based on the percentage of defective vehicles. For instance, the fleet management plan can include replacing for the fleet of vehicles based on the replacement rate, whether or not to utilize vehicles for the fleet of vehicles, performing maintenance for the fleet of vehicles based on the maintenance status, or a combination thereof.

By way of example, referring back to the two-OEM example, for the OEM, the estimating module 303 can determine a first OEM true positive rate $$\left(\text{e.g., } \frac{OEM_2}{OEM_1}\right)$$

based on a ratio of the first number of road reports (e.g., $OEM_1$) and the second number of road reports (e.g., $OEM_2$) determined from a first set of vehicles of the fleet of vehicles that are associated the first OEM. As mentioned, the first OEM fleet does not generate any false positive road event report. For a second OEM with some defective vehicles, the estimating module 303 can determine a second OEM false positive rate (e.g., $D_2/D_1$) based on a ratio of the first number of road reports (e.g., $D_1$) and the second number of road reports (e.g., D2) determined from a second set of vehicles of the fleet of vehicles that are associated the second OEM. Since the second OEM fleet has some defective vehicles, each of D1 and D2 includes true positive reports and false positive reports. Subsequently, the estimating module 303 can determine an OEM-specific percentage of defective vehicles in the second set of vehicles associated with the second OEM (e.g., $X_{fp}$) based on the first OEM true positive rate and the second OEM false positive rate (e.g., by comparing these two ratios and applying formula (8) to calculate the percentage of defective vehicles of the second OEM without the knowledge of the fleet size). As such, the fleet management plan can be determined for the second set of vehicles based on the OEM-specific percentage of defective vehicles in the second set of vehicles (e.g., $X_{fp}$).

In one embodiment, in step 703, the output module 311 can provide the fleet management plan as an output.

Figure 8C:
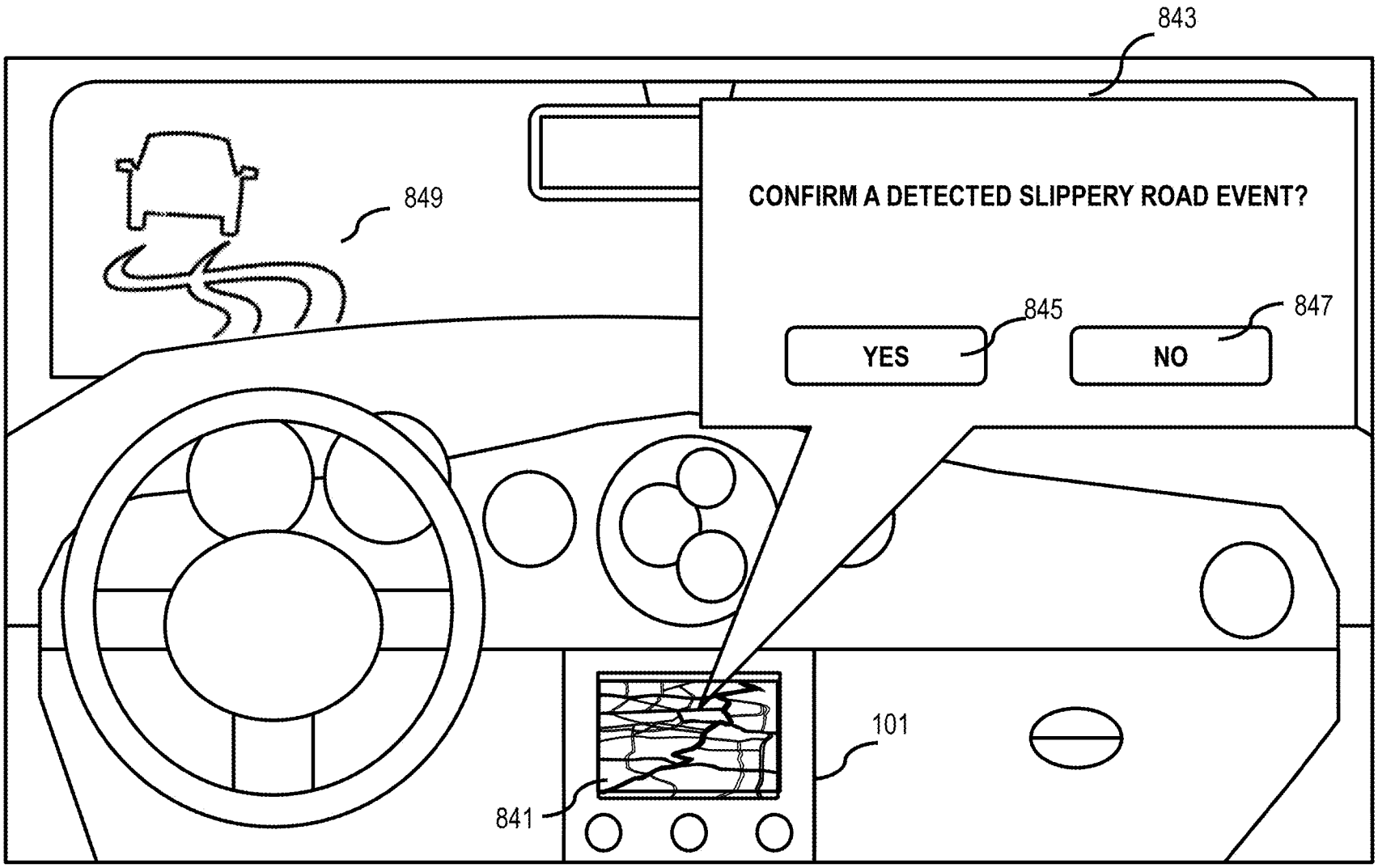

FIGS. 8A-8C are diagrams of example map user interfaces for adjusting and reporting detectable road events, according to various embodiments. Referring to FIG. 8A, in one embodiment, the system 100 can generate a user interface (UI) 801 (e.g., via the mapping platform 105, the application 111, etc.) for a UE 109 (e.g., a mobile device, a smartphone, a client terminal, etc.) that can allow a user (e.g., a mapping service provider staff, an OEM staff, an end user, etc.) to see road event data currently and/or over time (e.g., an hour, a day, a week, a month, a year, etc.) in an area presented over a map 803, upon selection of one type of road events (e.g., slippery road events). The user can access the data based on a respective data security access level. In addition, the user can select to view one or more types of data objects within the selected road event type (e.g., slippery road events), such as true slippery road reports 805*a* and false positive slippery road reports 805*b* in FIG. 8A. Moreover, the user can select one or more OEM sources by checking boxes 807*a*-807*e* for the selected road event type, data object type(s), etc. For instance, OEM 2 (e.g., the OEM with the issue of with a high engine torque and the specific combination of a head unit and ESP ECUs) is further selected, such that FIG. 8A shows the true slippery road reports 805*a* (e.g., in block dots) and the false positive slippery road reports 805*b* (e.g., in white dots) provided by the fleet of OEM 2. Subsequently, the user can select a button 809 to proceed with the fleet management functions as discussed above.

FIG. 8B is a diagram of an example user interface (UI) 821 (e.g., of a navigation application 111) capable of presenting true slippery road event data, according to one or more example embodiments. In this example, the UI 821 shown is generated for the UE 109 (e.g., a mobile device, an embedded navigation system of a vehicle 101, a client terminal, etc.) that includes a map 823, and a status indication 825 of "Monitoring slippery road events" by the system 100. The system 100 is monitoring slippery road event signals/reports in the area and adjusting the slippery road event signals/reports with a percentage of defective vehicles in a fleet of vehicles travelling in the area, in order to present in FIG. 8B only the true slippery road event data. For instance, the system 100 can adjust the slippery road event reports by evenly suppressing reported road event instances over the area based on the defective vehicle percentage. The system 100 also presents an option of "reroute" 827 in FIG. 8B for a user can select a "yes" button 829 or a "no" button 831 with respect to rerouting. Accordingly, when the user selects the "yes" button 829, the system 100 can provide the user navigation guidance based on the adjusted slippery road event reports.

In one instance, the UI 821 could also be presented via a headset, goggle, or eyeglass device used separately or in connection with a UE 109 (e.g., a mobile device). In one embodiment, the system 100 can present or surface the output data, the adjust traffic report data, etc. in multiple interfaces simultaneously (e.g., presenting a 2D map, a 3D map, an augmented reality view, a virtual reality display, or a combination thereof). In one embodiment, the system 100 could also present the output data to the user through other media including but not limited to one or more sounds, haptic feedback, touch, or other sensory interfaces. For example, the system 100 could present the output data through the speakers of a vehicle 101 carrying the user.

In FIG. 8C, the system 100 may provide interactive user interfaces (e.g., of UEs 109 associated with the vehicle 101) for reporting detected road events as confirmed via user inputs (e.g., crowd-sources via Mechanical Turk (MTurk)®, Crowd Flowers®, etc.). In one scenario, a user interface (UI) 841 of the vehicle 101 depicts a map, and prompts the user with a popup 843: "Confirm a detected road event?" An operator and/or a passenger of the vehicle 101 can select a "yes" button 845 or a "no" button 847 based on the user's observation (e.g., of a slippery road event 849).

For example, the user interface can present an UI 841 and/or a physical controller such as but not limited to an interface that enables voice commands, a pressure sensor on a screen or window whose intensity reflects the movement of time, an interface that enables gestures/touch interaction, a knob, a joystick, a rollerball or trackball-based interface, or other sensors. As other examples, the sensors can be any type of sensor that can detect a user's gaze, heartrate, sweat rate or perspiration level, eye movement, body movement, or combination thereof, in order to determine a user response to confirm road events. As such, the system 100 can enable a user to confirm road events (e.g., to provide the system 100 as ground truth data).

In one embodiment, the vehicle sensors 103 can include such as light sensor(s), orientation sensor(s) augmented with height sensor(s) and acceleration sensor(s), tilt sensor(s) to detect the degree of incline or decline of the vehicle along a path of travel, moisture sensor(s), pressure sensor(s), audio sensor(s) (e.g., microphone), 3D camera(s), radar system(s), LiDAR system(s), infrared camera(s), rear camera(s), ultrasound sensor(s), GPS receiver(s), windshield wiper sensor(s), ignition sensor(s), brake pressure sensor(s), head/fog/hazard light sensor(s), ABS sensor(s), ultrasonic parking sensor(s), electronic stability control sensor(s), vehicle speed sensor(s), mass airflow sensor(s), engine speed sensor(s), oxygen sensor(s), spark knock sensor(s), coolant sensor(s), manifold absolute pressure (MAF) sensor(s), fuel temperature sensor(s), voltage sensor(s), camshaft position sensor(s), throttle position sensor(s), O2 monitor(s), etc. operating at various locations in a vehicle.

In another embodiment, the sources of the sensors 103 may also include sensors configured to monitor passengers, such as O2 monitor(s), health sensor(s) (e.g. heart-rate monitor(s), blood pressure monitor(s), etc.), etc.

By way of example, the vehicle sensors 103 can detect external conditions such as an accident, weather data, etc. Further, the vehicle sensors 103 can detect the perimeter of the vehicle, the relative distance of the vehicle from sidewalks, lane or roadways, the presence of other vehicles, trees, benches, water, potholes and any other objects, etc. Still further, the vehicle sensors 103 may provide in-vehicle navigation services, location based services (e.g., road event reporting services), etc. to the vehicles 101.

As another example, the 3D camera can be used to detect and identify objects (e.g., vehicles, pedestrians, bicycles, traffic signs and signals, road markings, etc.), to determine road events, etc. For instance, the radar data (e.g., short-range, and long-range radar) can be used to compute object distances and speeds in relation to the vehicle in real time, even during fog or rain. For instance, the short-range (24 GHz) radar supports blind spot monitoring, lane-keeping, parking, etc., while the long-range (77 GHz) radar supports distance control and braking. The LiDAR data can be used the same way as the radar data to determine object distances and speeds, and additionally to create 3D images of the detected objects and the surroundings as well as a 360-degree map around the vehicle. The redundancy and overlapping sensor capabilities ensure autonomous vehicles to operate in a wide range of environmental and lighting conditions (e.g., rain, a jaywalking pedestrian at night, etc.).

In one embodiment, the sensor data is transmitted to the system 100 via V2X communication. A V2X (vehicle-to-everything) communication system can incorporate specific types of communication such as V2I (vehicle-to-infrastructure), V2N (vehicle-to-network), V2V (vehicle-to-vehicle), V2P (vehicle-to-pedestrian), V2D (vehicle-to-device), V2G (vehicle-to-grid), etc. In one embodiment, the V2X communication information can include any information between a vehicle and any entity that may affect the vehicle operation, such as forward collision warning, lane change warning/blind spot warning, emergency electric brake light warning, intersection movement assist, emergency vehicle approaching, roadworks warning, platooning, etc.

In one embodiment, the system 100 can process the sensor data to determine road events, while the V2X communication is optional. In another embodiment, the system 100 can process the sensor data to validate the road event reports.

In one embodiment, the system 100 can process the sensor data for detecting e.g., of objects, the environment, weather, etc., and determine a road event.

In one embodiment, the system 100 can determine an association between the sensor data and false positive road event reports (e.g., a cause of the false positive road event reports) based on a statistical analysis (e.g., using the machine learning system 113) of the false positive road event reports, historical false positive road event report data, or a combination thereof. Applicable machine learning algorithms may include a neural network, support vector machine (SVM), decision tree, k-nearest neighbors matching, etc. For example, the statistical analysis can determine the ESP ECUs of the OEM at issue as the primary cause of the false positive road event reports. As another example, the statistical analysis can determine turning with a high engine torque of the OEM fleet as a secondary cause of the false positive road event reports, along with one or more other causes, such as a new speed limit sign, distracted driving, speeding, etc. Other example causes include algorithms for deciding how autonomous vehicles are driven. For instance, a defective algorithm accelerates too fast to cause false positive slippery road event reports.

In one embodiment, a false positive cause machine learning model can be built by the machine learning system 113 based on the sensor data, false positive road event report data, ground truth data, etc. as training data. By way of example, the machine learning system 113 can use parameters/factors such as characteristics of the vehicle (e.g., model, age, maintenance records, etc.), characteristics of drivers/passengers (e.g., appointment/deliver schedules, comfort level preferences, etc.), driving context and conditions (e.g., road geometry/conditions, traffic, weather, etc.), map data, etc. that describe a distribution or a set of distributions of the false positive road event reports, thereby calculating cause(s) of the false positive road event reports (with a respective road event type, a respective map object type, etc.) as reported from various sources, such as the vehicles 101, government/municipality agencies, local or community agencies (e.g., a police department), and/or third-party official/semi-official sources.

In one embodiment, the machine learning system 113 can select respective weights of the parameters/factors, and/or various road event information sources, for example, based on their respective reliability. In another embodiment, the machine learning system 113 can further select or assign respective correlations, relationships, etc. among the road event information sources, for determining a confidence level of a false positive road event report. In one instance, the machine learning system 113 can continuously provide and/or update the false positive cause machine learning model using, for instance, a support vector machine (SVM), neural network, decision tree, etc.

The above-discussed embodiments investigate the role of the sensors 103 data configured in the vehicle 101 at a time of a false positive road event report to understand the cause leading to the false positive road event report, and to improve the learning loops for continuous improvements of the sensors 103, self-driving systems of the vehicles 101, the vehicles 101, the fleets, and/or the system 101 to reduce/prevent future false positive road event reports.

The above-discussed embodiments allow vehicles/fleets to effectively report road events (including an association between a false positive road event report and a cause) by determining a percentage of defective vehicles in the fleet of vehicles, and applying the percentage to adjust a total number of subsequently road event reports, to determine a replacement rate for the fleet of vehicles, to estimate a maintenance status of the fleet of vehicles, to determine a cause of false positive road event reports using machine learning, etc.

Returning to FIG. 1, in one embodiment, the mapping platform 105 has connectivity over the communication network 107 to the services platform 119 (e.g., an OEM platform) that provides services 121 (e.g., probe and/or sensor data collection services). By way of example, the services 121 may also be other third-party services and include mapping services, navigation services, traffic incident services, travel planning services, notification services, social networking services, content (e.g., audio, video, images, etc.) provisioning services, application services, storage services, contextual information determination services, location-based services, information-based services (e.g., weather, news, etc.), etc. In one embodiment, the services platform 119 uses the output (e.g. lane-level dangerous slowdown event detection and messages) of the mapping platform 105 to provide services such as navigation, mapping, other location-based services, etc.

In one embodiment, the mapping platform 105 may be a platform with multiple interconnected components. The mapping platform 105 may include multiple servers, intelligent networking devices, computing devices, components, and corresponding software for providing parametric representations of lane lines. In addition, it is noted that the mapping platform 105 may be a separate entity of the system 100, a part of the services platform 119, a part of the one or more services 121, or included within the vehicles 101 (e.g., an embedded navigation system).

In one embodiment, content providers 123 may provide content or data (e.g., including probe data, sensor data, etc.) to the mapping platform 105, the UEs 109, the applications 111, the geographic database 115, the services platform 119, the services 121, and the vehicles 101. The content provided may be any type of content, such as map content, textual content, audio content, video content, image content, etc. In one embodiment, the content providers 123 may provide content that may aid in localizing a vehicle path or trajectory on a lane of a digital map or link. In one embodiment, the content providers 123 may also store content associated with the mapping platform 105, the geographic database 115, the services platform 119, the services 121, and/or the vehicles 101. In another embodiment, the content providers 123 may manage access to a central repository of data, and offer a consistent, standard interface to data, such as a repository of the geographic database 115.

By way of example, the UEs 109 are any type of embedded system, mobile terminal, fixed terminal, or portable terminal including a built-in navigation system, a personal navigation device, mobile handset, station, unit, device, multimedia computer, multimedia tablet, Internet node, communicator, desktop computer, laptop computer, notebook computer, netbook computer, tablet computer, personal communication system (PCS) device, personal digital assistants (PDAs), audio/video player, digital camera/camcorder, positioning device, fitness device, television receiver, radio broadcast receiver, electronic book device, game device, or any combination thereof, including the accessories and peripherals of these devices, or any combination thereof. It is also contemplated that a UE 109 can support any type of interface to the user (such as "wearable" circuitry, etc.). In one embodiment, a UE 109 may be associated with a vehicle 101 (e.g., a mobile device) or be a component part of the vehicle 101 (e.g., an embedded navigation system). In one embodiment, the UEs 109 may include the mapping platform 105 to provide hybrid traffic incident identification.

In one embodiment, as mentioned above, the vehicles 101, for instance, are part of a probe-based system for collecting probe data and/or sensor data for detecting traffic incidents (e.g., dangerous slowdown events) and/or measuring traffic conditions in a road network. In one embodiment, each vehicle 101 is configured to report probe data as probe points, which are individual data records collected at a point in time that records telemetry data for that point in time. In one embodiment, the probe ID can be permanent or valid for a certain period of time. In one embodiment, the probe ID is cycled, particularly for consumer-sourced data, to protect the privacy of the source.

In one embodiment, a probe point can include attributes such as: (1) probe ID, (2) longitude, (3) latitude, (4) heading, (5) speed, and (6) time. The list of attributes is provided by way of illustration and not limitation. Accordingly, it is contemplated that any combination of these attributes or other attributes may be recorded as a probe point. For example, attributes such as altitude (e.g., for flight capable vehicles or for tracking non-flight vehicles in the altitude domain), tilt, steering angle, wiper activation, etc. can be included and reported for a probe point. In one embodiment, the vehicles 101 may include sensors 103 for reporting measuring and/or reporting attributes. The attributes can also be any attribute normally collected by an on-board diagnostic (OBD) system of the vehicle 101, and available through an interface to the OBD system (e.g., OBD II interface or other similar interface).

The probe points can be reported from the vehicles 101 in real-time, in batches, continuously, or at any other frequency requested by the system 100 over, for instance, the communication network 107 for processing by the mapping platform 105. The probe points also can be map matched to specific road links stored in the geographic database 115. In one embodiment, the system 100 (e.g., via the mapping platform 105) can generate probe traces (e.g., vehicle paths or trajectories) from the probe points for an individual probe so that the probe traces represent a travel trajectory or vehicle path of the probe through the road network.

In one embodiment, as previously stated, the vehicles 101 are configured with various sensors (e.g., vehicle sensors 103) for generating or collecting probe data, sensor data, related geographic/map data, etc. In one embodiment, the sensed data represents sensor data associated with a geographic location or coordinates at which the sensor data was collected. By way of example, the vehicle sensors 103 may include a RADAR system, a LiDAR system, global positioning sensor for gathering location data (e.g., GPS), a network detection sensor for detecting wireless signals or receivers for different short-range communications (e.g., Bluetooth, Wi-Fi, Li-Fi, near field communication (NFC) etc.), temporal information sensors, a camera/imaging sensor for gathering image data, an audio recorder for gathering audio data, velocity sensors mounted on a steering wheel of the vehicles 101, switch sensors for determining whether one or more vehicle switches are engaged, and the like. Though depicted as automobiles, it is contemplated the vehicles 101 can be any type of vehicle manned or unmanned (e.g., cars, trucks, buses, vans, motorcycles, scooters, drones, etc.) that travel through road segments of a road network.

Other examples of sensors 103 of the vehicle 101 may include light sensors, orientation sensors augmented with height sensors and acceleration sensor (e.g., an accelerometer can measure acceleration and can be used to determine orientation of the vehicle), tilt sensors to detect the degree of incline or decline of the vehicle 101 along a path of travel (e.g., while on a hill or a cliff), moisture sensors, pressure sensors, etc. In a further example embodiment, sensors 103 about the perimeter of the vehicle 101 may detect the relative distance of the vehicle 101 from a physical divider, a lane line of a link or roadway, the presence of other vehicles, pedestrians, traffic lights, potholes and any other objects, or a combination thereof. In one scenario, the vehicle sensors 103 may detect weather data, traffic information, or a combination thereof. In one embodiment, the vehicles 101 may include GPS or other satellite-based receivers to obtain geographic coordinates from satellites 125 for determining current location and time. Further, the location can be determined by visual odometry, triangulation systems such as A-GPS, Cell of Origin, or other location extrapolation technologies.

In one embodiment, the UEs 109 may also be configured with various sensors (not shown for illustrative convenience) for acquiring and/or generating probe data and/or sensor data associated with a vehicle 101, a driver, other vehicles, conditions regarding the driving environment or roadway, etc. For example, such sensors may be used as GPS receivers for interacting with the one or more satellites 125 to determine and track the current speed, position, and location of a vehicle 101 travelling along a link or roadway. In addition, the sensors may gather tilt data (e.g., a degree of incline or decline of the vehicle during travel), motion data, light data, sound data, image data, weather data, temporal data and other data associated with the vehicles 101 and/or UEs 109. Still further, the sensors may detect local or transient network and/or wireless signals, such as those transmitted by nearby devices during navigation of a vehicle along a roadway (Li-Fi, near field communication (NFC)) etc.

It is noted therefore that the above described data may be transmitted via communication network 107 as probe data (e.g., GPS probe data) according to any known wireless communication protocols. For example, each UE 109, application 111, user, and/or vehicle 101 may be assigned a unique probe identifier (probe ID) for use in reporting or transmitting said probe data collected by the vehicles 101 and/or UEs 109. In one embodiment, each vehicle 101 and/or UE 109 is configured to report probe data as probe points, which are individual data records collected at a point in time that records telemetry data.

In one embodiment, the mapping platform 105 retrieves aggregated probe points gathered and/or generated by the vehicle sensors 103 and/or the UE 109 resulting from the travel of the UEs 109 and/or vehicles 101 on a road segment of a road network. In one instance, the geographic database 115 stores a plurality of probe points and/or trajectories generated by different vehicle sensors 103, UEs 109, applications 111, vehicles 101, etc. over a period while traveling in a monitored area. A time sequence of probe points specifies a trajectory—i.e., a path traversed by a UE 109, application 111, vehicle 101, etc. over the period.

In one embodiment, the communication network 107 of the system 100 includes one or more networks such as a data network, a wireless network, a telephony network, or any combination thereof. It is contemplated that the data network may be any local area network (LAN), metropolitan area network (MAN), wide area network (WAN), a public data network (e.g., the Internet), short range wireless network, or any other suitable packet-switched network, such as a commercially owned, proprietary packet-switched network, e.g., a proprietary cable or fiber-optic network, and the like, or any combination thereof. In addition, the wireless network may be, for example, a cellular network and may employ various technologies including enhanced data rates for global evolution (EDGE), general packet radio service (GPRS), global system for mobile communications (GSM), Internet protocol multimedia subsystem (IMS), universal mobile telecommunications system (UMTS), etc., as well as any other suitable wireless medium, e.g., worldwide interoperability for microwave access (WiMAX), Long Term Evolution (LTE) networks, 5G networks, code division multiple access (CDMA), wideband code division multiple access (WCDMA), wireless fidelity (Wi-Fi), wireless LAN (WLAN), Bluetooth®, Internet Protocol (IP) data casting, satellite, mobile ad-hoc network (MANET), and the like, or any combination thereof.

By way of example, the vehicles 101, vehicle sensors 103, mapping platform 105, UEs 109, applications 111, services platform 119, services 121, content providers 123, and/or satellites 125 communicate with each other and other components of the system 100 using well known, new or still developing protocols. In this context, a protocol includes a set of rules defining how the network nodes within the communication network 107 interact with each other based on information sent over the communication links. The protocols are effective at different layers of operation within each node, from generating and receiving physical signals of various types, to selecting a link for transferring those signals, to the format of information indicated by those signals, to identifying which software application executing on a computer system sends or receives the information. The conceptually different layers of protocols for exchanging information over a network are described in the Open Systems Interconnection (OSI) Reference Model.

Communications between the network nodes are typically effected by exchanging discrete packets of data. Each packet typically comprises (1) header information associated with a particular protocol, and (2) payload information that follows the header information and contains information that may be processed independently of that particular protocol. In some protocols, the packet includes (3) trailer information following the payload and indicating the end of the payload information. The header includes information such as the source of the packet, its destination, the length of the payload, and other properties used by the protocol. Often, the data in the payload for the particular protocol includes a header and payload for a different protocol associated with a different, higher layer of the OSI Reference Model. The header for a particular protocol typically indicates a type for the next protocol contained in its payload. The higher layer protocol is said to be encapsulated in the lower layer protocol. The headers included in a packet traversing multiple heterogeneous networks, such as the Internet, typically include a physical (layer 1) header, a data-link (layer 2) header, an internetwork (layer 3) header and a transport (layer 4) header, and various application (layer 5, layer 6 and layer 7) headers as defined by the OSI Reference Model.

The processes described herein for estimating false positive reports of detectable road events using two groups of vehicles may be advantageously implemented via software, hardware (e.g., general processor, Digital Signal Processing (DSP) chip, an Application Specific Integrated Circuit (ASIC), Field Programmable Gate Arrays (FPGAs), etc.), firmware or a combination thereof. Such exemplary hardware for performing the described functions is detailed below.

Figure 9:
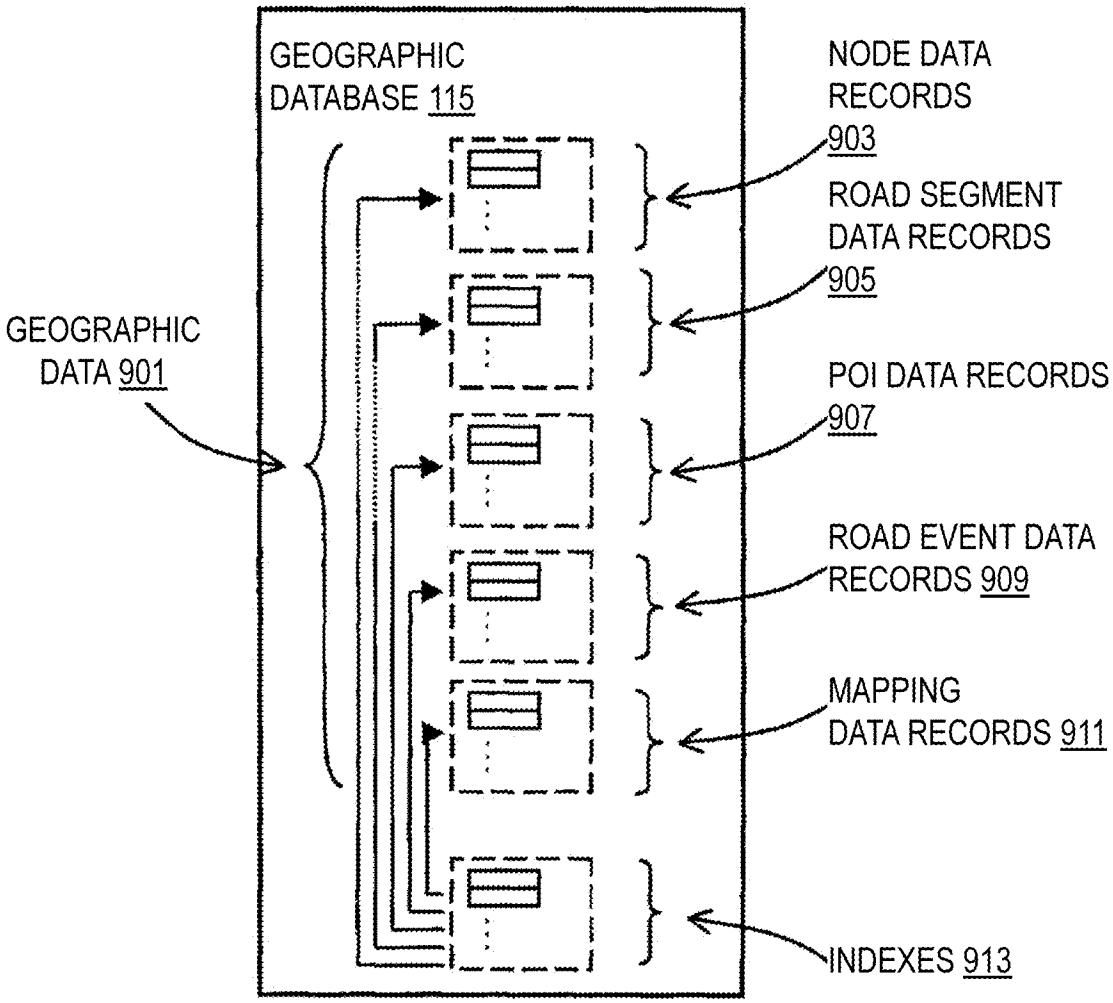
FIG. 9 is a diagram of a geographic database, according to one embodiment.

FIG. 9 is a diagram of a geographic database (such as the database 115), according to one embodiment. In one embodiment, the geographic database 115 includes geographic data 901 used for (or configured to be compiled to be used for) mapping and/or navigation-related services, such as for video odometry based on the parametric representation of lanes include, e.g., encoding and/or decoding parametric representations into lane lines. In one embodiment, the geographic database 115 include high resolution or high definition (HD) mapping data that provide centimeter-level or better accuracy of map features. For example, the geographic database 115 can be based on LiDAR or equivalent technology to collect billions of 3D points and model road surfaces and other map features down to the number lanes and their widths. In one embodiment, the mapping data (e.g., mapping data records 911) capture and store details such as the slope and curvature of the road, lane markings, roadside objects such as signposts, including what the signage denotes. By way of example, the mapping data enable highly automated vehicles to precisely localize themselves on the road.

In one embodiment, geographic features (e.g., two-dimensional, or three-dimensional features) are represented using polygons (e.g., two-dimensional features) or polygon extrusions (e.g., three-dimensional features). For example, the edges of the polygons correspond to the boundaries or edges of the respective geographic feature. In the case of a building, a two-dimensional polygon can be used to represent a footprint of the building, and a three-dimensional polygon extrusion can be used to represent the three-dimensional surfaces of the building. It is contemplated that although various embodiments are discussed with respect to two-dimensional polygons, it is contemplated that the embodiments are also applicable to three-dimensional polygon extrusions. Accordingly, the terms polygons and polygon extrusions as used herein can be used interchangeably.

In one embodiment, the following terminology applies to the representation of geographic features in the geographic database 115.

"Node"—A point that terminates a link.

"Line segment"—A straight line connecting two points.

"Link" (or "edge")—A contiguous, non-branching string of one or more line segments terminating in a node at each end.

"Shape point"—A point along a link between two nodes (e.g., used to alter a shape of the link without defining new nodes).

"Oriented link"—A link that has a starting node (referred to as the "reference node") and an ending node (referred to as the "non reference node").

"Simple polygon"—An interior area of an outer boundary formed by a string of oriented links that begins and ends in one node. In one embodiment, a simple polygon does not cross itself.

"Polygon"—An area bounded by an outer boundary and none or at least one interior boundary (e.g., a hole or island). In one embodiment, a polygon is constructed from one outer simple polygon and none or at least one inner simple polygon. A polygon is simple if it just consists of one simple polygon, or complex if it has at least one inner simple polygon.

In one embodiment, the geographic database 115 follows certain conventions. For example, links do not cross themselves and do not cross each other except at a node. Also, there are no duplicated shape points, nodes, or links. Two links that connect each other have a common node. In the geographic database 115, overlapping geographic features are represented by overlapping polygons. When polygons overlap, the boundary of one polygon crosses the boundary of the other polygon. In the geographic database 115, the location at which the boundary of one polygon intersects they boundary of another polygon is represented by a node. In one embodiment, a node may be used to represent other locations along the boundary of a polygon than a location at which the boundary of the polygon intersects the boundary of another polygon. In one embodiment, a shape point is not used to represent a point at which the boundary of a polygon intersects the boundary of another polygon.

As shown, the geographic database 115 includes node data records 903, road segment or link data records 905, POI data records 907, road event data records 909, mapping data records 911, and indexes 913, for example. More, fewer, or different data records can be provided. In one embodiment, additional data records (not shown) can include cartographic ("carto") data records, routing data, and maneuver data. In one embodiment, the indexes 913 may improve the speed of data retrieval operations in the geographic database 115. In one embodiment, the indexes 913 may be used to quickly locate data without having to search every row in the geographic database 115 every time it is accessed. For example, in one embodiment, the indexes 913 can be a spatial index of the polygon points associated with stored feature polygons.

In exemplary embodiments, the road segment data records 905 are links or segments representing roads, streets, or paths, as can be used in the calculated route or recorded route information for determination of one or more personalized routes. The node data records 903 are end points (such as intersections) corresponding to the respective links or segments of the road segment data records 905. The road link data records 905 and the node data records 903 represent a road network, such as used by vehicles, cars, and/or other entities. Alternatively, the geographic database 115 can contain path segment and node data records or other data that represent pedestrian paths or areas in addition to or instead of the vehicle road record data, for example.

The road/link segments and nodes can be associated with attributes, such as geographic coordinates, street names, address ranges, speed limits, turn restrictions at intersections, and other navigation related attributes, as well as POIs, such as gasoline stations, hotels, restaurants, museums, stadiums, offices, automobile dealerships, auto repair shops, buildings, stores, parks, etc. The geographic database 115 can include data about the POIs and their respective locations in the POI data records 907. The geographic database 115 can also include data about places, such as cities, towns, or other communities, and other geographic features, such as bodies of water, mountain ranges, etc. Such place or feature data can be part of the POI data records 907 or can be associated with POIs or POI data records 907 (such as a data point used for displaying or representing a position of a city).

In one embodiment, the geographic database 115 can also include road event data records 909 for storing sensor data, road event report data, cause and false positive road event reports association data, training data, prediction models, annotated observations, computed featured distributions, sampling probabilities, and/or any other data generated or used by the system 100 according to the various embodiments described herein. By way of example, the road event data records 909 can be associated with one or more of the node records 903, road segment records 905, and/or POI data records 907 to support localization or visual odometry based on the features stored therein and the corresponding estimated quality of the features. In this way, the road event data records 909 can also be associated with or used to classify the characteristics or metadata of the corresponding records 903, 905, and/or 907.

In one embodiment, as discussed above, the mapping data records 911 model road surfaces and other map features to centimeter-level or better accuracy. The mapping data records 911 also include lane models that provide the precise lane geometry with lane boundaries, as well as rich attributes of the lane models. These rich attributes include, but are not limited to, lane traversal information, lane types, lane marking types, lane level speed limit information, and/or the like. In one embodiment, the mapping data records 911 are divided into spatial partitions of varying sizes to provide mapping data to vehicles 101 and other end user devices with near real-time speed without overloading the available resources of the vehicles 101 and/or devices (e.g., computational, memory, bandwidth, etc. resources).

In one embodiment, the mapping data records 911 are created from high-resolution 3D mesh or point-cloud data generated, for instance, from LiDAR-equipped vehicles. The 3D mesh or point-cloud data are processed to create 3D representations of a street or geographic environment at centimeter-level accuracy for storage in the mapping data records 911.

In one embodiment, the mapping data records 911 also include real-time sensor data collected from probe vehicles in the field. The real-time sensor data, for instance, integrates real-time traffic information, weather, and road conditions (e.g., potholes, road friction, road wear, etc.) with highly detailed 3D representations of street and geographic features to provide precise real-time also at centimeter-level accuracy. Other sensor data can include vehicle telemetry or operational data such as windshield wiper activation state, braking state, steering angle, accelerator position, and/or the like. In one embodiment, certain attributes, such as HD records, mapping data records and/or other attributes can be features or layers associated with the link-node structure of the database.

In one embodiment, the geographic database 115 can be maintained by the content provider 121 in association with the services platform 119 (e.g., a map developer). The map developer can collect geographic data to generate and enhance the geographic database 115. There can be different ways used by the map developer to collect data. These ways can include obtaining data from other sources, such as municipalities or respective geographic authorities. In addition, the map developer can employ field personnel to travel by vehicle (e.g., vehicles 101 and/or user terminals 109) along roads throughout the geographic region to observe features and/or record information about them, for example. Also, remote sensing, such as aerial or satellite photography, can be used.

The geographic database 115 can be a master geographic database stored in a format that facilitates updating, maintenance, and development. For example, the master geographic database or data in the master geographic database can be in an Oracle spatial format or other spatial format, such as for development or production purposes. The Oracle spatial format or development/production database can be compiled into a delivery format, such as a geographic data files (GDF) format. The data in the production and/or delivery formats can be compiled or further compiled to form geographic database products or databases, which can be used in end user navigation devices or systems.

For example, geographic data is compiled (such as into a platform specification format (PSF) format) to organize and/or configure the data for performing navigation-related functions and/or services, such as route calculation, route guidance, map display, speed calculation, distance and travel time functions, and other functions, by a navigation device, such as by a vehicle 101 or a user terminal 109, for example. The navigation-related functions can correspond to vehicle navigation, pedestrian navigation, or other types of navigation. The compilation to produce the end user databases can be performed by a party or entity separate from the map developer. For example, a customer of the map developer, such as a navigation device developer or other end user device developer, can perform compilation on a received geographic database in a delivery format to produce one or more compiled navigation databases.

Figure 10:
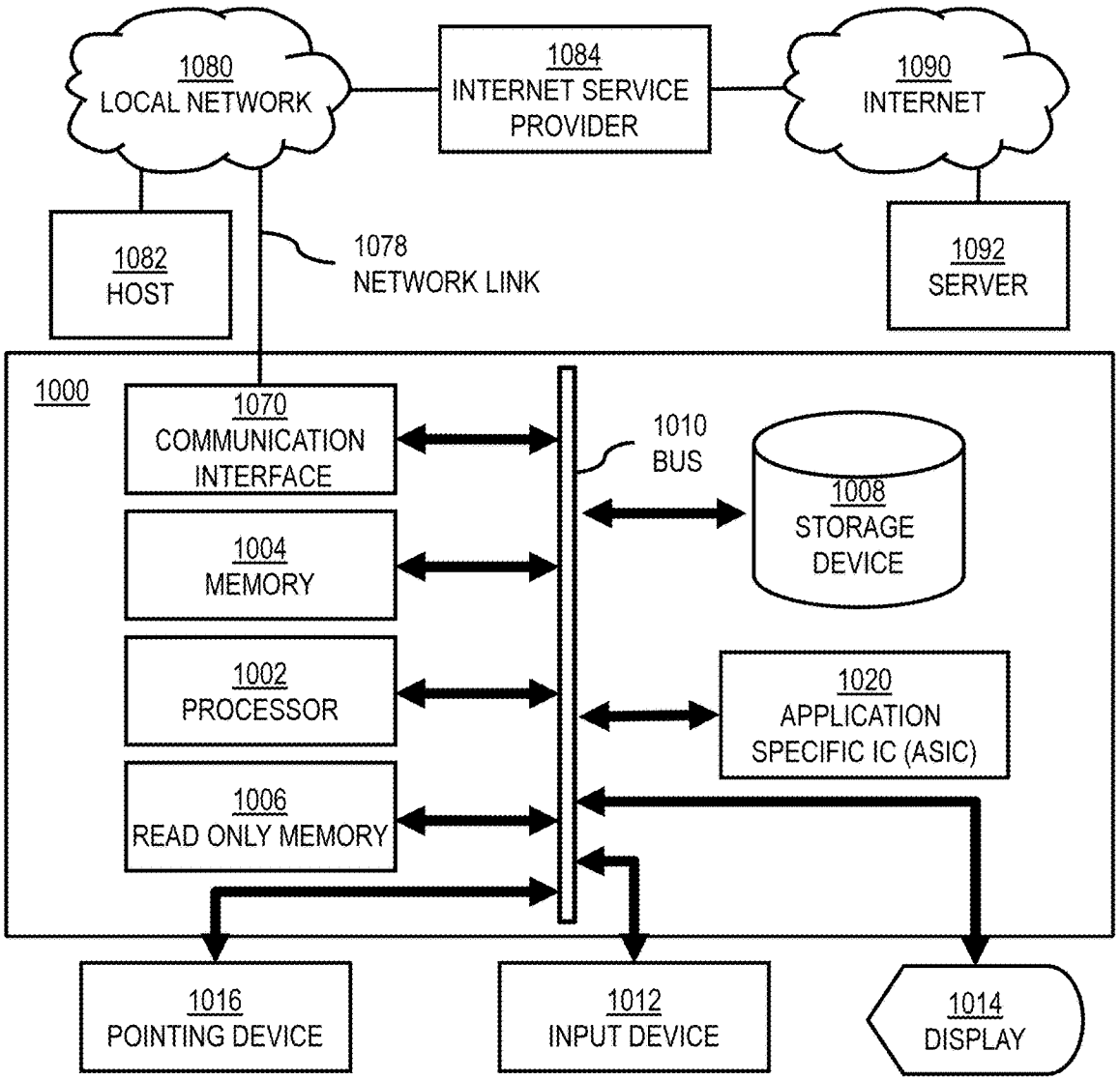
FIG. 10 is a diagram of hardware that can be used to implement a system or process described herein, according to one or more example embodiments.

FIG. 10 illustrates a computer system 1000 upon which an embodiment of the invention may be implemented. Computer system 1000 is programmed (e.g., via computer program code or instructions) to evaluate, report, and handle an autonomous vehicle s described herein and includes a communication mechanism such as a bus 1010 for passing information between other internal and external components of the computer system 1000. Information (also called data) is represented as a physical expression of a measurable phenomenon, typically electric voltages, but including, in other embodiments, such phenomena as magnetic, electromagnetic, pressure, chemical, biological, molecular, atomic, sub-atomic and quantum interactions. For example, north and south magnetic fields, or a zero and non-zero electric voltage, represent two states (0, 1) of a binary digit (bit). Other phenomena can represent digits of a higher base. A superposition of multiple simultaneous quantum states before measurement represents a quantum bit (qubit). A sequence of one or more digits constitutes digital data that is used to represent a number or code for a character. In some embodiments, information called analog data is represented by a near continuum of measurable values within a particular range.

A bus 1010 includes one or more parallel conductors of information so that information is transferred quickly among devices coupled to the bus 1010. One or more processors 1002 for processing information are coupled with the bus 1010.

A processor 1002 performs a set of operations on information as specified by computer program code related to estimating false positive reports of detectable road events using two groups of vehicles. The computer program code is a set of instructions or statements providing instructions for the operation of the processor and/or the computer system to perform specified functions. The code, for example, may be written in a computer programming language that is compiled into a native instruction set of the processor. The code may also be written directly using the native instruction set (e.g., machine language). The set of operations include bringing information in from the bus 1010 and placing information on the bus 1010. The set of operations also typically include comparing two or more units of information, shifting positions of units of information, and combining two or more units of information, such as by addition or multiplication or logical operations like OR, exclusive OR (XOR), and AND. Each operation of the set of operations that can be performed by the processor is represented to the processor by information called instructions, such as an operation code of one or more digits. A sequence of operations to be executed by the processor 1002, such as a sequence of operation codes, constitute processor instructions, also called computer system instructions or, simply, computer instructions. Processors may be implemented as mechanical, electrical, magnetic, optical, chemical or quantum components, among others, alone or in combination.

Computer system 1000 also includes a memory 1004 coupled to bus 1010. The memory 1004, such as a random access memory (RAM) or other dynamic storage device, stores information including processor instructions for estimating false positive reports of detectable road events using two groups of vehicles. Dynamic memory allows information stored therein to be changed by the computer system 1000. RAM allows a unit of information stored at a location called a memory address to be stored and retrieved independently of information at neighboring addresses. The memory 1004 is also used by the processor 1002 to store temporary values during execution of processor instructions. The computer system 1000 also includes a read only memory (ROM) 1006 or other static storage device coupled to the bus 1010 for storing static information, including instructions, that is not changed by the computer system 1000. Some memory is composed of volatile storage that loses the information stored thereon when power is lost. Also coupled to bus 1010 is a non-volatile (persistent) storage device 1008, such as a magnetic disk, optical disk, or flash card, for storing information, including instructions, that persists even when the computer system 1000 is turned off or otherwise loses power.

Information, including instructions for estimating false positive reports of detectable road events using two groups of vehicles, is provided to the bus 1010 for use by the processor from an external input device 1012, such as a keyboard containing alphanumeric keys operated by a human user, or a sensor. A sensor detects conditions in its vicinity and transforms those detections into physical expression compatible with the measurable phenomenon used to represent information in computer system 1000. Other external devices coupled to bus 1010, used primarily for interacting with humans, include a display device 1014, such as a cathode ray tube (CRT) or a liquid crystal display (LCD), or plasma screen or printer for presenting text or images, and a pointing device 1016, such as a mouse or a trackball or cursor direction keys, or motion sensor, for controlling a position of a small cursor image presented on the display 1014 and issuing commands associated with graphical elements presented on the display 1014. In some embodiments, for example, in embodiments in which the computer system 1000 performs all functions automatically without human input, one or more of external input device 1012, display device 1014 and pointing device 1016 is omitted.

In the illustrated embodiment, special purpose hardware, such as an application specific integrated circuit (ASIC) 1020, is coupled to bus 1010. The special purpose hardware is configured to perform operations not performed by processor 1002 quickly enough for special purposes. Examples of application specific ICs include graphics accelerator cards for generating images for display 1014, cryptographic boards for encrypting and decrypting messages sent over a network, speech recognition, and interfaces to special external devices, such as robotic arms and medical scanning equipment that repeatedly perform some complex sequence of operations that are more efficiently implemented in hardware.

Computer system 1000 also includes one or more instances of a communications interface 1070 coupled to bus 1010. Communication interface 1070 provides a one-way or two-way communication coupling to a variety of external devices that operate with their own processors, such as printers, scanners, and external disks. In general the coupling is with a network link 1078 that is connected to a local network 1080 to which a variety of external devices with their own processors are connected. For example, communication interface 1070 may be a parallel port or a serial port or a universal serial bus (USB) port on a personal computer. In some embodiments, communications interface 1070 is an integrated services digital network (ISDN) card or a digital subscriber line (DSL) card or a telephone modem that provides an information communication connection to a corresponding type of telephone line. In some embodiments, a communication interface 1070 is a cable modem that converts signals on bus 1010 into signals for a communication connection over a coaxial cable or into optical signals for a communication connection over a fiber optic cable. As another example, communications interface 1070 may be a local area network (LAN) card to provide a data communication connection to a compatible LAN, such as Ethernet. Wireless links may also be implemented. For wireless links, the communications interface 1070 sends or receives or both sends and receives electrical, acoustic, or electromagnetic signals, including infrared and optical signals, that carry information streams, such as digital data. For example, in wireless handheld devices, such as mobile telephones like cell phones, the communications interface 1070 includes a radio band electromagnetic transmitter and receiver called a radio transceiver. In certain embodiments, the communications interface 1070 enables connection to the communication network 107 for estimating false positive reports of detectable road events using two groups of vehicles to the mapping platform 105, the UEs 109, etc.

The term computer-readable medium is used herein to refer to any medium that participates in providing information to processor 1002, including instructions for execution. Such a medium may take many forms, including, but not limited to, non-volatile media, volatile media, and transmission media. Non-volatile media include, for example, optical or magnetic disks, such as storage device 1008. Volatile media include, for example, dynamic memory 1004. Transmission media include, for example, coaxial cables, copper wire, fiber optic cables, and carrier waves that travel through space without wires or cables, such as acoustic waves and electromagnetic waves, including radio, optical and infrared waves. Signals include man-made transient variations in amplitude, frequency, phase, polarization, or other physical properties transmitted through the transmission media. Common forms of computer-readable media include, for example, a floppy disk, a flexible disk, hard disk, magnetic tape, any other magnetic medium, a CD-ROM, CDRW, DVD, any other optical medium, punch cards, paper tape, optical mark sheets, any other physical medium with patterns of holes or other optically recognizable indicia, a RAM, a PROM, an EPROM, a FLASH-EPROM, any other memory chip or cartridge, a carrier wave, or any other medium from which a computer can read.

Network link 1078 typically provides information communication using transmission media through one or more networks to other devices that use or process the information. For example, network link 1078 may provide a connection through local network 1080 to a host computer 1082 or to equipment 1084 operated by an Internet Service Provider (ISP). ISP equipment 1084 in turn provides data communication services through the public, world-wide packet-switching communication network of networks now commonly referred to as the Internet 1090.

A computer called a server host 1092 connected to the Internet hosts a process that provides a service in response to information received over the Internet. For example, server host 1092 hosts a process that provides information representing video data for presentation at display 1014. It is contemplated that the components of system can be deployed in various configurations within other computer systems, e.g., host 1082 and server 1092.

FIG. 11 illustrates a chip set 1100 upon which an embodiment of the invention may be implemented. Chip set 1100 is programmed to estimate false positive reports of detectable road events using two groups of vehicles as described herein and includes, for instance, the processor and memory components described with respect to FIG. 10 incorporated in one or more physical packages (e.g., chips). By way of example, a physical package includes an arrangement of one or more materials, components, and/or wires on a structural assembly (e.g., a baseboard) to provide one or more characteristics such as physical strength, conservation of size, and/or limitation of electrical interaction. It is contemplated that in certain embodiments the chip set can be implemented in a single chip.

In one embodiment, the chip set 1100 includes a communication mechanism such as a bus 1101 for passing information among the components of the chip set 1100. A processor 1103 has connectivity to the bus 1101 to execute instructions and process information stored in, for example, a memory 1105. The processor 1103 may include one or more processing cores with each core configured to perform independently. A multi-core processor enables multiprocessing within a single physical package. Examples of a multi-core processor include two, four, eight, or greater numbers of processing cores. Alternatively or in addition, the processor 1103 may include one or more microprocessors configured in tandem via the bus 1101 to enable independent execution of instructions, pipelining, and multithreading. The processor 1103 may also be accompanied with one or more specialized components to perform certain processing functions and tasks such as one or more digital signal processors (DSP) 1107, or one or more application-specific integrated circuits (ASIC) 1109. A DSP 1107 typically is configured to process real-world signals (e.g., sound) in real time independently of the processor 1103. Similarly, an ASIC 1109 can be configured to performed specialized functions not easily performed by a general purposed processor. Other specialized components to aid in performing the inventive functions described herein include one or more field programmable gate arrays (FPGA) (not shown), one or more controllers (not shown), or one or more other special-purpose computer chips.

The processor 1103 and accompanying components have connectivity to the memory 1105 via the bus 1101. The memory 1105 includes both dynamic memory (e.g., RAM, magnetic disk, writable optical disk, etc.) and static memory (e.g., ROM, CD-ROM, etc.) for storing executable instructions that when executed perform the inventive steps described herein to estimate false positive reports of detectable road events using two groups of vehicles. The memory 1105 also stores the data associated with or generated by the execution of the inventive steps.

Figure 12:
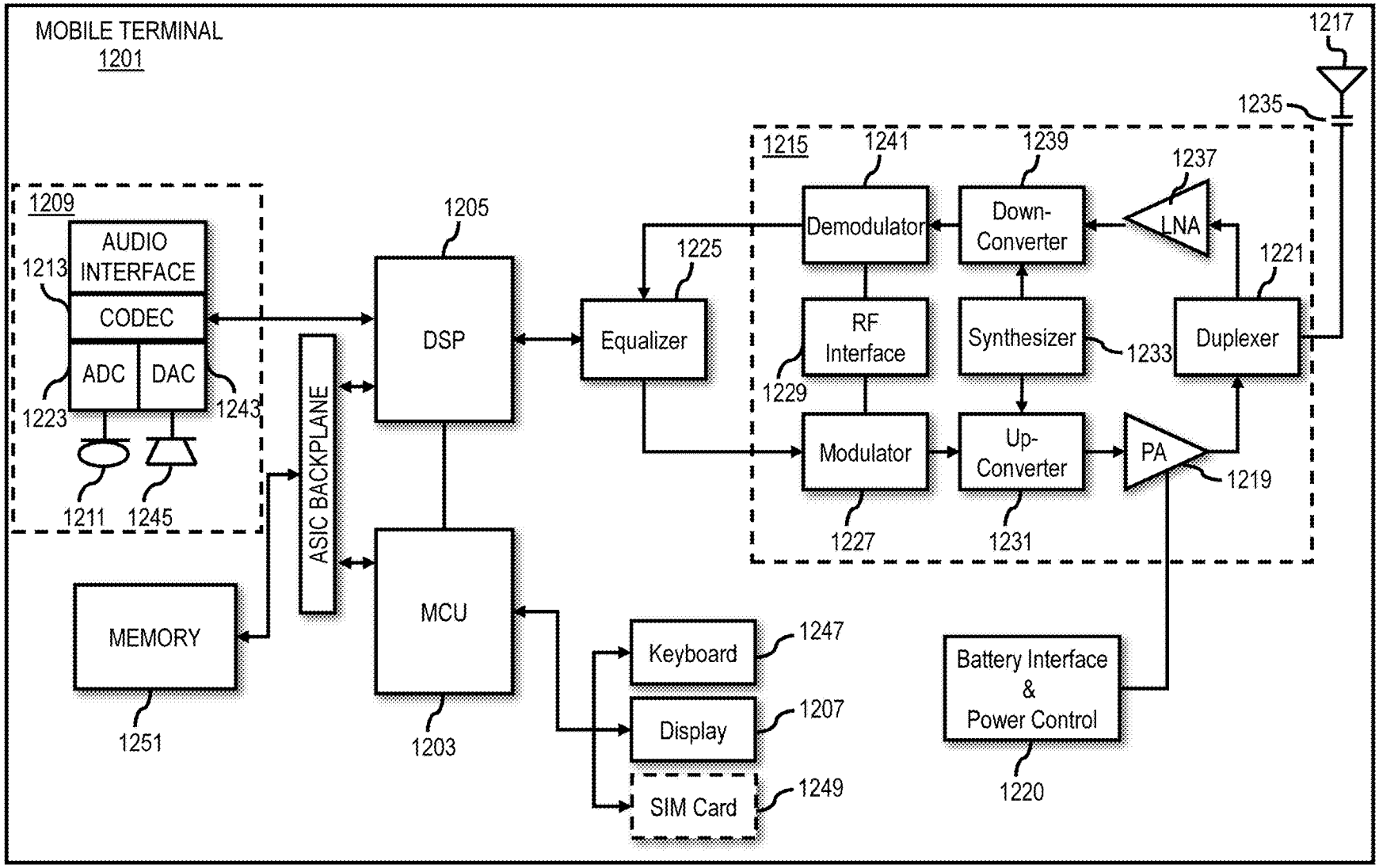
FIG. 12 is a diagram of a mobile terminal (e.g., handset or vehicle or part thereof) that can be used to implement a system or process described herein, according to one or more example embodiments.

FIG. 12 is a diagram of exemplary components of a mobile terminal 1201 (e.g., handset, vehicle or a part thereof) capable of operating in the system of FIG. 1, according to one embodiment. Generally, a radio receiver is often defined in terms of front-end and back-end characteristics. The front-end of the receiver encompasses all of the Radio Frequency (RF) circuitry whereas the back-end encompasses all of the base-band processing circuitry. Pertinent internal components of the telephone include a Main Control Unit (MCU) 1203, a Digital Signal Processor (DSP) 1205, and a receiver/transmitter unit including a microphone gain control unit and a speaker gain control unit. A main display unit 1207 provides a display to the user in support of various applications and mobile station functions that offer automatic contact matching. An audio function circuitry 1209 includes a microphone 1211 and microphone amplifier that amplifies the speech signal output from the microphone 1211. The amplified speech signal output from the microphone 1211 is fed to a coder/decoder (CODEC) 1213.

A radio section 1215 amplifies power and converts frequency in order to communicate with a base station, which is included in a mobile communication system, via antenna 1217. The power amplifier (PA) 1219 and the transmitter/modulation circuitry are operationally responsive to the MCU 1203, with an output from the PA 1219 coupled to the duplexer 1221 or circulator or antenna switch, as known in the art. The PA 1219 also couples to a battery interface and power control unit 1220.

In use, a user of the mobile station 1201 speaks into the microphone 1211 and his or her voice along with any detected background noise is converted into an analog voltage. The analog voltage is then converted into a digital signal through the Analog to Digital Converter (ADC) 1223. The control unit 1203 routes the digital signal into the DSP 1205 for processing therein, such as speech encoding, channel encoding, encrypting, and interleaving. In one embodiment, the processed voice signals are encoded, by units not separately shown, using a cellular transmission protocol such as global evolution (EDGE), general packet radio service (GPRS), global system for mobile communications (GSM), Internet protocol multimedia subsystem (IMS), universal mobile telecommunications system (UMTS), etc., as well as any other suitable wireless medium, e.g., microwave access (WiMAX), Long Term Evolution (LTE) networks, code division multiple access (CDMA), wireless fidelity (WiFi), satellite, and the like.

The encoded signals are then routed to an equalizer 1225 for compensation of any frequency-dependent impairments that occur during transmission though the air such as phase and amplitude distortion. After equalizing the bit stream, the modulator 1227 combines the signal with a RF signal generated in the RF interface 1229. The modulator 1227 generates a sine wave by way of frequency or phase modulation. In order to prepare the signal for transmission, an up-converter 1231 combines the sine wave output from the modulator 1227 with another sine wave generated by a synthesizer 1233 to achieve the desired frequency of transmission. The signal is then sent through a PA 1219 to increase the signal to an appropriate power level. In practical systems, the PA 1219 acts as a variable gain amplifier whose gain is controlled by the DSP 1205 from information received from a network base station. The signal is then filtered within the duplexer 1221 and optionally sent to an antenna coupler 1235 to match impedances to provide maximum power transfer. Finally, the signal is transmitted via antenna 1217 to a local base station. An automatic gain control (AGC) can be supplied to control the gain of the final stages of the receiver. The signals may be forwarded from there to a remote telephone which may be another cellular telephone, other mobile phone or a land-line connected to a Public Switched Telephone Network (PSTN), or other telephony networks.

Voice signals transmitted to the mobile station 1201 are received via antenna 1217 and immediately amplified by a low noise amplifier (LNA) 1237. A down-converter 1239 lowers the carrier frequency while the demodulator 1241 strips away the RF leaving only a digital bit stream. The signal then goes through the equalizer 1225 and is processed by the DSP 1205. A Digital to Analog Converter (DAC) 1243 converts the signal and the resulting output is transmitted to the user through the speaker 1245, all under control of a Main Control Unit (MCU) 1203—which can be implemented as a Central Processing Unit (CPU) (not shown).

The MCU 1203 receives various signals including input signals from the keyboard 1247. The keyboard 1247 and/or the MCU 1203 in combination with other user input components (e.g., the microphone 1211) comprise a user interface circuitry for managing user input. The MCU 1203 runs a user interface software to facilitate user control of at least some functions of the mobile station 1201 to estimate false positive reports of detectable road events using two groups of vehicles. The MCU 1203 also delivers a display command and a switch command to the display 1207 and to the speech output switching controller, respectively. Further, the MCU 1203 exchanges information with the DSP 1205 and can access an optionally incorporated SIM card 1249 and a memory 1251. In addition, the MCU 1203 executes various control functions required of the station. The DSP 1205 may, depending upon the implementation, perform any of a variety of conventional digital processing functions on the voice signals. Additionally, DSP 1205 determines the background noise level of the local environment from the signals detected by microphone 1211 and sets the gain of microphone 1211 to a level selected to compensate for the natural tendency of the user of the mobile station 1201.

The CODEC 1213 includes the ADC 1223 and DAC 1243. The memory 1251 stores various data including call incoming tone data and is capable of storing other data including music data received via, e.g., the global Internet. The software module could reside in RAM memory, flash memory, registers, or any other form of writable computer-readable storage medium known in the art including non-transitory computer-readable storage medium. For example, the memory device 1251 may be, but not limited to, a single memory, CD, DVD, ROM, RAM, EEPROM, optical storage, or any other non-volatile or non-transitory storage medium capable of storing digital data.

An optionally incorporated SIM card 1249 carries, for instance, information such as the cellular phone number, the carrier supplying service, subscription details, and security information. The SIM card 1249 serves primarily to identify the mobile station 1201 on a radio network. The card 1249 also contains a memory for storing a personal telephone number registry, text messages, and user specific mobile station settings.

While the invention has been described in connection with a number of embodiments and implementations, the invention is not so limited but covers various obvious modifications and equivalent arrangements, which fall within the purview of the appended claims. Although features of the invention are expressed in certain combinations among the claims, it is contemplated that these features can be arranged in any combination and order.

What is claimed is:

1. A method comprising:

determining a first number of road reports from a fleet of vehicles operating in a geographic area during a first time period and a second number of road reports from the fleet of vehicles operating in the geographic area during a second time period, wherein the first number of road reports and the second number of road reports relate to a road event detected by one or more vehicle sensors;

computing a difference between the first number of road reports and the second number of road reports;

determining a percentage of defective vehicles in the fleet of vehicles based on the difference, wherein the defective vehicles are defective with respect to a detection of the road event; and providing the percentage of defective vehicles as an output.

2. The method of claim 1, wherein the road event is a slippery road event.

3. The method of claim 1, wherein the first time period is associated with the geographic area experiencing a first environmental condition causing a slippery road condition above a threshold slipperiness level.

4. The method of claim 3, wherein the second time period is associated with the geographic area experiencing a second environmental condition causing a dry road condition below a threshold dryness level.

5. The method of claim 1, further comprising:

for a first original equipment manufacturer (OEM), determining a first OEM true positive rate based on a ratio of the first number of road reports and the second number of road reports determined from a first set of vehicles of the fleet of vehicles that are associated the first OEM;

for a second OEM, determining a second OEM false positive rate based on a ratio of the first number of road reports and the second number of road reports determined from a second set of vehicles of the fleet of vehicles that are associated the second OEM; and determining an OEM-specific percentage of defective vehicles in the second set of vehicles associated with the second OEM based on the first OEM true positive rate and the second OEM false positive rate.

6. The method of claim 5, wherein the first set of vehicles associated with the first OEM include a number of defective vehicles below a threshold value.

7. The method of claim 5, wherein the first set of vehicles and the second set of vehicles have an equal number of vehicles within a threshold range.

8. The method of claim 1, further comprising:

adjusting a total number of road reports subsequently reported by the fleet of vehicles in the geographic based on the percentage of defective vehicles.

9. The method of claim 1, further comprising:

determining a replacement rate for the fleet of vehicles based on the percentage of defective vehicles.

10. The method of claim 1, further comprising:

estimating a maintenance status of the fleet of vehicles based on the percentage of defective vehicles.

11. An apparatus comprising:

at least one processor; and at least one memory including computer program code for one or more programs, the at least one memory and the computer program code configured to, with the at least one processor, cause the apparatus to perform at least the following, generate a map layer based on road reports reported by a fleet of vehicles operating in a geographic area;

quantify a quality of the map layer based on a percentage of defective vehicles in the fleet of vehicles, wherein the defective vehicles are defective with respect to a detection of a road event; and selectively provide the map layer as an output based on the quality of the map layer, wherein the percentage of defective vehicles in the fleet of vehicles is determined based on a difference between a first number of road reports from the fleet of vehicles during a first time period and a second number of road reports from the fleet of vehicles during a second time period, and wherein the first number of road reports and the second number of road reports relate to the road event detected by one or more vehicle sensors.

12. The apparatus of claim 11, wherein the road events are slippery road events, pedestrian detecting events, signage detecting events, road divider detecting events, accident detecting events, or congestion detecting events.

13. The apparatus of claim 11, wherein the first time period is associated with the geographic area experiencing a first environmental condition causing a first road event condition above a threshold level, and wherein the second time period is associated with the geographic area experiencing a second environmental condition causing a second road event condition below a threshold dryness level, wherein the second road event condition is opposite to the first road event condition.

14. The apparatus of claim 11, wherein the apparatus is further caused to:

filter or reject road reports from one or more original equipment manufacturer (OEM) sources each of which has a defective vehicle rate higher than a threshold, wherein the map layer is generated based on the remaining road reports after the filtering or rejection.

15. The apparatus of claim 14, wherein the apparatus is further caused to:

for a first OEM, determine a first OEM true positive rate based on a ratio of the first number of road reports and the second number of road reports determined from a first set of vehicles of the fleet of vehicles that are associated the first OEM;

for a second OEM, determine a second OEM false positive rate based on a ratio of the first number of road reports and the second number of road reports determined from a second set of vehicles of the fleet of vehicles that are associated the second OEM; and determine an OEM-specific percentage of defective vehicles in the second set of vehicles associated with the second OEM based on the first OEM true positive rate and the second OEM false positive rate, wherein the road reports from the second OEM is filtered or rejected based on the OEM-specific percentage of defective vehicles in the second set of vehicles.

16. The apparatus of claim 15, wherein the first set of vehicles associated with the first OEM include a number of defective vehicles below a threshold value, and wherein the first set of vehicles and the second set of vehicles have an equal number of vehicles within a threshold range.

17. A non-transitory computer-readable storage medium carrying one or more sequences of one or more instructions which, when executed by one or more processors, cause an apparatus to perform:

determining a fleet management plan for a fleet of vehicles based on a percentage of defective vehicles in the fleet of vehicles, wherein the defective vehicles are defective with respect to a detection of a road event; and providing the fleet management plan as an output, wherein the percentage of defective vehicles in the fleet of vehicles is determined based on a difference between a first number of road reports from the fleet of vehicles during a first time period and a second number of road reports from the fleet of vehicles during a second time period, and wherein the first number of road reports and the second number of road reports relate to the road event detected by one or more vehicle sensors.

18. The non-transitory computer-readable storage medium of claim 17, wherein the apparatus is caused to further perform:

monitoring the percentage of defective vehicles in the fleet of vehicles overtime; and updating the fleet management plan based on the monitored percentage of defective vehicles.

19. The non-transitory computer-readable storage medium of claim 17, wherein the apparatus is caused to further perform at least one of:

determining a replacement rate for the fleet of vehicles based on the percentage of defective vehicles, and estimating a maintenance status of the fleet of vehicles based on the percentage of defective vehicles, wherein the fleet management plan includes replacing for the fleet of vehicles based on the replacement rate, performing maintenance for the fleet of vehicles based on the maintenance status, or a combination thereof.

20. The non-transitory computer-readable storage medium of claim 17, wherein the apparatus is caused to further perform at least one of:

for a first original equipment manufacturer (OEM), determining a first OEM true positive rate based on a ratio of the first number of road reports and the second number of road reports determined from a first set of vehicles of the fleet of vehicles that are associated the first OEM;

for a second OEM, determining a second OEM false positive rate based on a ratio of the first number of road reports and the second number of road reports determined from a second set of vehicles of the fleet of vehicles that are associated the second OEM; and determining an OEM-specific percentage of defective vehicles in the second set of vehicles associated with the second OEM based on the first OEM true positive rate and the second OEM false positive rate, wherein the fleet management plan is determined for the second set of vehicles based on the OEM-specific percentage of defective vehicles in the second set of vehicles.

* * * * *